US010672579B2

(12) United States Patent
Woo et al.

(10) Patent No.: US 10,672,579 B2
(45) Date of Patent: Jun. 2, 2020

(54) CIRCUIT BREAKER WITH INSTANT TRIP MECHANISM

(71) Applicant: LSIS CO., LTD., Anyang-si, Gyeonggi-do (KR)

(72) Inventors: Sanghyun Woo, Anyang-si (KR); Jeongjae Lim, Anyang-si (KR); Seungjin Ham, Anyang-si (KR)

(73) Assignee: LSIS CO., LTD., Anyang-si, Gyeonggi-Do (KR)

( * ) Notice: Subject to any disclaimer, the term of this patent is extended or adjusted under 35 U.S.C. 154(b) by 129 days.

(21) Appl. No.: 15/914,738

(22) Filed: Mar. 7, 2018

(65) Prior Publication Data

US 2018/0261417 A1 Sep. 13, 2018

(30) Foreign Application Priority Data

Mar. 9, 2017 (KR) ..... 10-2017-0030223
Mar. 9, 2017 (KR) ..... 10-2017-0030226
May 17, 2017 (KR) ..... 10-2017-0061177

(51) Int. Cl.
*H01H 83/00* (2006.01)
*H01H 71/24* (2006.01)
(Continued)

(52) U.S. Cl.
CPC .... *H01H 71/2472* (2013.01); *H01H 71/2409* (2013.01); *H01H 71/405* (2013.01);
(Continued)

(58) Field of Classification Search
CPC ..... H01H 71/2472
(Continued)

(56) References Cited

U.S. PATENT DOCUMENTS 3,278,708 A * 10/1966 Casey ..... H01H 71/405 337/70
4,706,054 A 11/1987 Hampton et al.
(Continued)

FOREIGN PATENT DOCUMENTS

CN 101699609 A 4/2010
CN 201918334 U 8/2011
(Continued)

OTHER PUBLICATIONS

European Search Report for related European Application No. 18158867.4; report dated Jul. 12, 2018; (7 pages).
(Continued)

*Primary Examiner* — Alexander Talpalatski
(74) *Attorney, Agent, or Firm* — K&L Gates LLP

(57) ABSTRACT

The circuit breaker according to the present invention comprises: a pair of contact mechanisms for switching a pair of circuits; a switching mechanism for driving the pair of contact mechanism to a circuit opening position or a circuit closing position; a trip bar rotatable to a first position for latching the switching mechanism or to a second position for releasing the switching mechanism; and an instant trip mechanism for pressing the trip bar to rotate to the second position, wherein the instant trip mechanism comprises a pair of armature assemblies and movable to a position for pressing the trip bar to rotate to the second position; and a pair of electromagnets provided to face the pair of armature assemblies and applies a magnetic attractive force to the pair of armature assemblies in response to the fault current on the circuit requiring an instant trip.

13 Claims, 27 Drawing Sheets

(51) Int. Cl.

| | |
|---|---|
| ***H01H 71/40*** | (2006.01) |
| ***H01H 73/66*** | (2006.01) |
| ***H01H 73/50*** | (2006.01) |
| ***H01H 71/50*** | (2006.01) |
| ***H01H 71/52*** | (2006.01) |
| *H01H 83/14* | (2006.01) |

(52) U.S. Cl.
CPC ..... *H01H 71/505* (2013.01); *H01H 71/524* (2013.01); *H01H 73/50* (2013.01); *H01H 73/66* (2013.01); *H01H 83/144* (2013.01); *H01H 2071/249* (2013.01)

(58) Field of Classification Search
USPC ..... 335/21
See application file for complete search history.

(56) References Cited

U.S. PATENT DOCUMENTS

| | | | | |
|---|---|---|---|---|
| 5,831,499 | A * | 11/1998 | Batteux | H01H 71/44 335/9 |
| 5,872,495 | A | 2/1999 | Dimarco et al. | |
| 6,972,649 | B1 | 12/2005 | Murthy et al. | |
| 6,980,069 | B2 | 12/2005 | O'Keeffe et al. | |
| 8,040,209 | B2 * | 10/2011 | Faik | H01H 71/7463 335/172 |
| 8,587,393 | B2 * | 11/2013 | Azzola | H01H 71/2472 335/170 |
| 2002/0171519 | A1 * | 11/2002 | Lanning | H01H 71/2472 335/172 |
| 2004/0150495 | A1 | 8/2004 | Lias et al. | |
| 2005/0072200 | A1 | 4/2005 | Hering | |
| 2009/0115556 | A1 * | 5/2009 | Faik | H01H 71/2472 335/42 |
| 2013/0207755 | A1 | 8/2013 | Lehmann | |

FOREIGN PATENT DOCUMENTS

| | | | |
|---|---|---|---|
| CN | 103456577 | A | 12/2013 |
| CN | 104779127 | A | 7/2015 |
| CN | 205657032 | U | 10/2016 |
| EP | 3096340 | A1 | 11/2016 |
| FR | 2943455 | A1 | 9/2010 |
| JP | H1050194 | A | 2/1998 |
| JP | 2000215779 | A | 8/2000 |
| JP | 3444215 | B2 | 9/2003 |
| JP | 2014107199 | A | 6/2014 |
| JP | 6030934 | B2 | 11/2016 |
| KR | 20040020428 | A | 3/2004 |
| KR | 200359413 | | 8/2004 |
| KR | 200468359 | Y1 | 8/2013 |
| KR | 1020160031591 | A | 3/2016 |

OTHER PUBLICATIONS

Korean Office Action for related Korean Application No. 10-2017-0061177; action dated dated May 2, 2018; (6 pages).
Korean Office Action for related Korean Application No. 10-2017-0030223; action dated Feb. 5, 2018; (6 pages).
Korean Office Action for related Korean Application No. 10-2017-0030226; action dated Feb. 6, 2018; (6 pages).
Chinese Office Action for related Chinese Application No. 201810187622.8; action dated Jun. 6, 2019; (14 pages).

* cited by examiner

CIRCUIT BREAKER WITH INSTANT TRIP MECHANISM

CROSS-REFERENCE TO RELATED APPLICATION

Pursuant to 35 U.S.C. § 119(a), this application claims the benefit of earlier filing dates and rights of priority to Korean Application No. 10-2017-0030223, filed on Mar. 9, 2017, Korean Application No. 10-2017-0030226, filed on Mar. 9, 2017 and Korean Application No. 10-2017-0061177, filed on May 17, 2017, the contents of which are incorporated by reference herein in their entirety.

BACKGROUND OF THE DISCLOSURE

1. Field of the Disclosure

The present disclosure relates to a circuit breaker, and particularly to a miniature circuit breaker having an instant trip mechanism (generally called an "MCB", abbreviated as "a circuit breaker" hereinafter) used for household use.

2. Background of the Disclosure

Generally, a circuit breaker switches an electric power circuit (abbreviated as a circuit hereinafter). To this end, the circuit breaker is placed on the circuit between an electric power source and an electric load. The circuit breaker may connect the circuit to the closed state and break the circuit. The circuit breaker may manually switch the circuit by user's operation. The circuit breaker may detect a fault current such as an overcurrent or a short-circuit current and automatically break (that is, trip) the circuit. In the event of overcurrent on the circuit reaching about 120% of a rated current, such a circuit breaker may perform a long time delay trip operation to break the circuit by a thermal trip mechanism such as a bimetal. The circuit breaker is required to perform an instant trip operation when an instant breaking required current such as a short circuit current which is several times to several tens of times the rated current in the circuit occurs.

The circuit breaker used for domestic use is a small-sized circuit breaker capable of switching a 2-poles circuits such as an R pole and a T pole. The present invention relates to such a circuit breaker, and a configuration and operation of a conventional circuit breaker will be described with reference to FIGS. 1 to 3.

As shown in FIG. 1, the circuit breaker 100 comprises a contact mechanism 110, a switching mechanism 120, a trip bar 190, and a trip mechanism 130.

The contact mechanism 110 comprises a stationary contact arm 115 and a movable contact arm 117.

The switching mechanism 120 is a mechanism for driving the contact mechanism 110 to a circuit closing position or a circuit opening position. And the switching mechanism 120 comprises a handle 120*a*, a U-shaped connecting pin 120*b*, a lever 120*c*, a cross bar 120*d*, and a compression spring (not shown).

The handle 120*a* provides a means for manually opening or closing the miniature circuit breaker 100 to a user.

The U-shaped connecting pin 120*b* is a component having an upper end connected to a lower portion of the handle 120*a* and a lower end connected to the lever 120*c* and connects the handle 120*a* with the lever 120*c*.

The lever 120*c* is connected to the lower end of the U-shaped connecting pin 120*b* at its substantially middle portion in the longitudinal direction and has one end which is latched or released by a trip bar 190 described later.

The cross bar 120*d* is provided across the movable contact arm 117 for switching the 2-poles circuits and has a lying U-shaped support portion for supporting the movable contact arm 117 interposed between both ends.

The compression spring (not shown) is installed between the cross bar 120*d* and a bottom surface of an enclosure of the circuit breaker 100 for elastically biasing the movable contact arm 117 to move from the corresponding stationary contact arm 115 to the circuit opening position in which the movable contact arm 117 is separated from the stationary contact arm 115 via the cross bar 120*d*.

When the circuit breaker 100 trips, the compression spring is a driving source for moving the movable contact arm 117 via the cross bar 120*d*.

The trip bar 190 is rotatable as a component having an alphabetical "Y" shape having a bifurcated upper branch portion and a lower end that provides a pivot axis by a support shaft that is not shown Both ends of the branch portion are provided with adjusting screws for adjusting a gap from the bimetal 140 as described later.

The trip bar 190 has a support groove portion for latching (locking) or releasing one end of the lever 120*c* between both forks of the upper branch portion.

The trip mechanism 130 comprises the bimetal 140 that can be bent in response to an overcurrent on the circuit.

The trip mechanism 130 may further comprise a heater (not given a reference numeral) connected to the circuit and capable of heating the bimetal 140.

The operation of the circuit breaker 100 according to the related art configured as described above will be briefly described.

First, a reset operation will be described.

When the user manipulates the handle 120*a* to an OFF position from an ON position (state) shown in FIG. 1 (when the user rotates in a clockwise direction from the state shown in FIG. 1), corresponding manual operation force lifts the lever 120*c* via the U-shaped connecting pin 120*b*.

The one end of the lever 120*c* is engaged by the support groove portion of the trip bar 190 and latched.

Also, as the lever 120*c* rises, the cross bar 120*d* rises by an elastic force of the compression spring, so that the movable contact arm 117 also rises, and thus, the movable contact arm 117 is separated from the stationary contact arm 115.

In the reset state, when the user operates the handle 120*a* to the ON position as shown in FIG. 1, the corresponding manual operation force presses the lever 120*c* downward through the U-shaped connecting pin 120*b* and the corresponding pressing force presses the cross bar 120*d* to move downward.

The movable contact arm 117 supported by both ends of the cross bar 120*d* descends and contacts the stationary contact arm 115 so that a current flowing from an electric power source side terminal flows to an electric load side terminal via the stationary contact arm 115, the movable contact arm 117, the bimetal 140, a conductive wire (not given a reference numeral), forming a closed loop, so that electric power is supplied from the electric power source side of the circuit to the electric load side.

Also, at this time, the compression spring is pressed by the downward movement of the cross bar 120*d*, so that the compression spring (not shown) becomes a charged state with elastic energy.

In the ON position (circuit closing position), if an overcurrent occurs on the circuit, the corresponding overcurrent flows to the stationary contact arm 115, the movable contact arm 117, the bimetal 140 and the conductive wire as shown in FIG. 2.

As shown in FIG. 3, the bimetal 140 is bent due to heating based on the overcurrent, to press and the trip bar 190.

Thus, the trip bar 190 rotates in a clockwise direction as indicated by the dotted line in the figure, releasing the one end of the lever 120*c*.

Then, as the elastic energy charged by the compression spring is discharged, the cross bar 120*d* rises, so that the movable contact arm 117 supported by the cross bar 120*d* also rises to be separated from the corresponding stationary contact arm 115, and accordingly, the circuit is automatically broken (tripped).

However, in the circuit breaker 100, there is a problem in that a time delay occurs in switching the circuit to the closed state (switching to the ON state) after breaking the circuit in response to the fault current of the circuit. That is, the stationary contact arm 115 and the movable contact arm 117 cannot contact each other until the bimetal 140 is cooled. If heat is left in the bimetal 140, the bimetal 140 continues to be bent, so the trip bar 190 also maintains a state of being rotated as indicated by the dotted line in FIG. 3. This is because, in this state, a reset operation is impossible and a subsequent operation of switching to the ON state is also impossible.

In addition, regarding a large fault current such as a short-circuit current requiring an instant trip among fault currents, the trip mechanism of the circuit breaker according to the related art comprises only a bimetal having a slow response speed, instant tripping is impossible.

In addition, the circuit breaker has a small receiving area, making it difficult to install the instant trip mechanism.

SUMMARY OF THE DISCLOSURE

Therefore, an aspect of the detailed description is to provide a circuit breaker having an instant trip mechanism capable of performing instant tripping before an operation of a bimetal to thereby prevent time delay during a reclosing operation.

Another aspect of the detailed description is to provide a circuit breaker having an instant trip mechanism which can be suitably mounted on a circuit breaker.

To achieve these and other advantages and in accordance with the purpose of this disclosure, as embodied and broadly described herein, a circuit breaker according to this disclosure comprising: a pair of contact mechanisms that are provided to correspond to a pair of circuits corresponding to a pair of poles and switch the pair of circuits; a switching mechanism that is commonly provided in the pair of contact mechanisms and drives the pair of contact mechanisms to a circuit opening position or a circuit closing position; a trip bar that is rotatable to a first position for latching the switching mechanism in the circuit closing position or to a second position for releasing the switching mechanism to operate to the circuit opening position; and an instant trip mechanism that presses the trip bar to rotate to the second position in response to a fault current on the circuit requiring an instant trip, wherein the instant trip mechanism comprises a pair of armature assemblies that are provided to correspond to the pair of poles and movable to a position for pressing the trip bar to rotate to the second position; and a pair of electromagnets that are provided to face the pair of armature assemblies and applies a magnetic attractive force to the pair of armature assemblies in response to the fault current on the circuit requiring an instant trip.

According to a preferred aspect of the disclosure, each of the pair of armature assemblies comprises a first armature portion that is pivotally supported to be rotatable and has a cam surface portion for pressing the trip bar; a second armature portion that is coupled to the first armature so as to be rotatable together and disposed to face the corresponding electromagnet; and a coupling portion that couples the first armature portion and the second armature portion.

According to another aspect of the disclosure, the second armature portion is installed to at least partially overlap the facing electromagnet in order to increase a mutually facing area.

According to still another aspect of the disclosure, the circuit breaker according to the disclosure further comprises a pair of bimetals that are connected to the pair of circuits, wherein the second armature portion is installed to surround each of the bimetal together with the facing electromagnet to form a closed loop of a magnetic path together with the corresponding electromagnet.

According to still another aspect of the disclosure, the second armature portion comprises a base portion that is disposed to face the corresponding electromagnet; and at least one wing portion that is extending from the base portion toward the corresponding electromagnet.

According to still another aspect of the disclosure, mutually facing surfaces of the wing portion of the second armature portion and the electromagnet are formed as inclined surfaces to increase a mutually facing area.

According to still another aspect of the disclosure, the electromagnet comprises a first electromagnet portion that is plate-shaped and disposed to face the corresponding second armature portion; and a pair of second electromagnet portions that are wing-shaped and extending from the first electromagnet portion toward the corresponding second armature portion.

According to still another aspect of the disclosure, a wing portion of the second armature portion comprises a stepped portion formed to have a shape corresponding to an end surface of the second electromagnet portion in order to increase the mutually facing area.

According to still another aspect of the disclosure, the electromagnet is configured as an L-shaped conductive metal plate having a vertical plate portion and a horizontal plate portion, and the second armature portion comprises: a base plate installed to face the vertical plate portion of the corresponding electromagnet; and at least one wing portion extending from the base plate portion toward the corresponding electromagnet.

According to still another aspect of the disclosure, each of the pair of electromagnets comprises a cutout groove portion that is provided at a side surface corner or an upper surface for guiding a conductive wire electrically connecting a movable contact arm of a corresponding contact mechanism among the pair of contact mechanisms and a terminal.

According to still another aspect of the disclosure, the electromagnet comprises a first base plane portion facing the second armature portion and a first wing portion extending from the first base plane portion toward the second armature portion, the second armature portion comprises a second base plane portion disposed to face the first base plane portion of the electromagnet and a second wing portion extending from the second base plane portion toward the electromagnet and meshed with the electromagnet, any one of the first wing portion and the second wing portion comprises at least one concave portion formed to be concave on a surface facing the other of the first wing portion or the second wing portion, and the other of the first wing portion and the second wing portion comprises at least one convex portion formed to be convex to correspond to the concave portion.

According to still another aspect of the disclosure, the electromagnet comprises a first base plane portion facing the second armature portion and a first wing portion extending from the first based plane portion toward the second armature portion, the second armature portion comprises a second base plane portion disposed to face the first base plane portion of the electromagnet and a second wing portion extending from the second base plane portion toward the electromagnet and meshed with the electromagnet, and the first wing portion and the second wing portion have a plurality of teeth meshed with each other.

According to still another aspect of the disclosure, the electromagnet comprises a first base plane portion facing the second armature portion and a first wing portion extending from the first based plane portion toward the second armature portion, the second armature portion comprises a second base plane portion disposed to face the first base plane portion of the electromagnet and a second wing portion extending from the second base plane portion toward the electromagnet and meshed with the electromagnet, and the first wing portion and the second wing portion have meander surfaces or a plurality of step surfaces meshed with each other.

According to still another aspect of the disclosure, the convex portion and the concave portion are formed in any one of a polygonal shape or a semicircular shape.

BRIEF DESCRIPTION OF THE DRAWING PORTIONS

The accompanying drawing portions, which are included to provide a further understanding of the disclosure and are incorporated in and constitute a part of this specification, illustrate exemplary embodiments and together with the description serve to explain the principles of the disclosure.

In the drawing portions:

FIG. 11A is a perspective view of a major part of the circuit breaker according to the first embodiment of the present invention;

FIG. 11B is a plan view of the electromagnet and the second armature portion of the circuit breaker according to the first embodiment of the present invention;

FIGS. 18A to 18D are views showing operation states from an ON state to a state when an instant trip is completed in the circuit breaker according to the second embodiment of the present invention, in which FIG. 18A is a view of a major part showing a state of a circuit breaker according to the second embodiment of the present invention in an ON state;

FIG. 18B is a view of a major part showing an operation state of a second armature portion and a first armature portion of the circuit breaker according to the second embodiment of the present invention in an initial state of an instant trip operation;

Figure 18A:
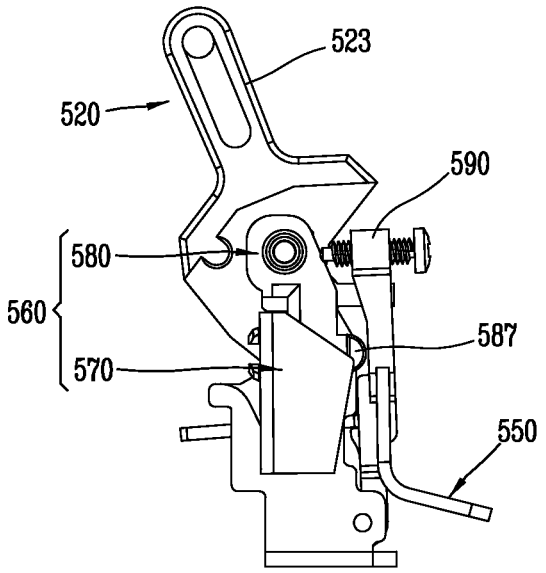
Figure 18B:
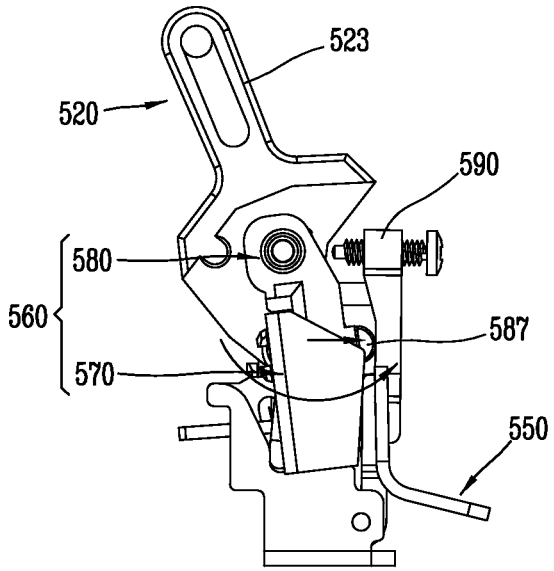
Figure 18C:
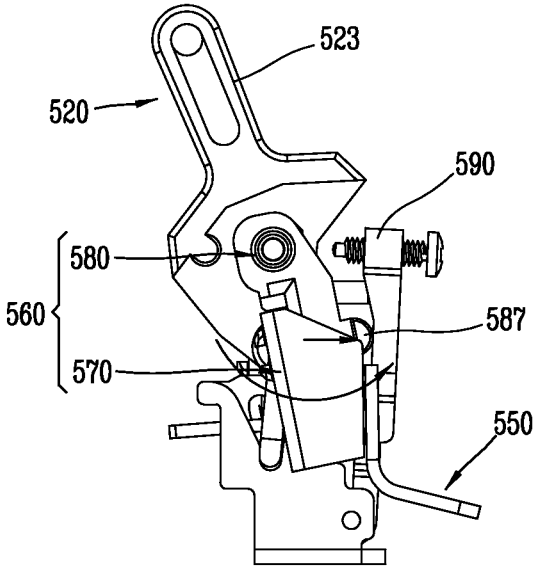
Figure 18D:
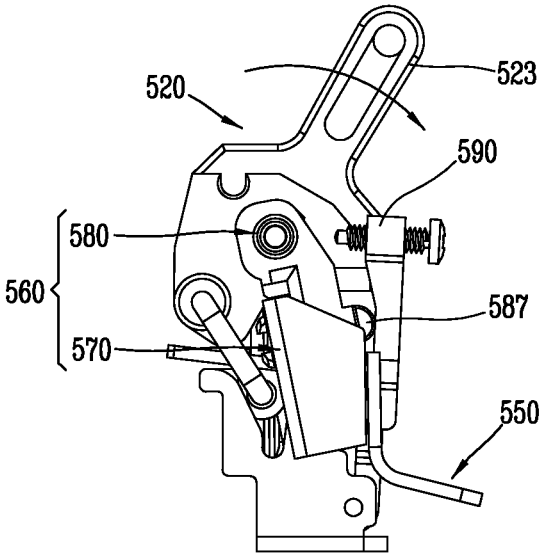
Figure 19:
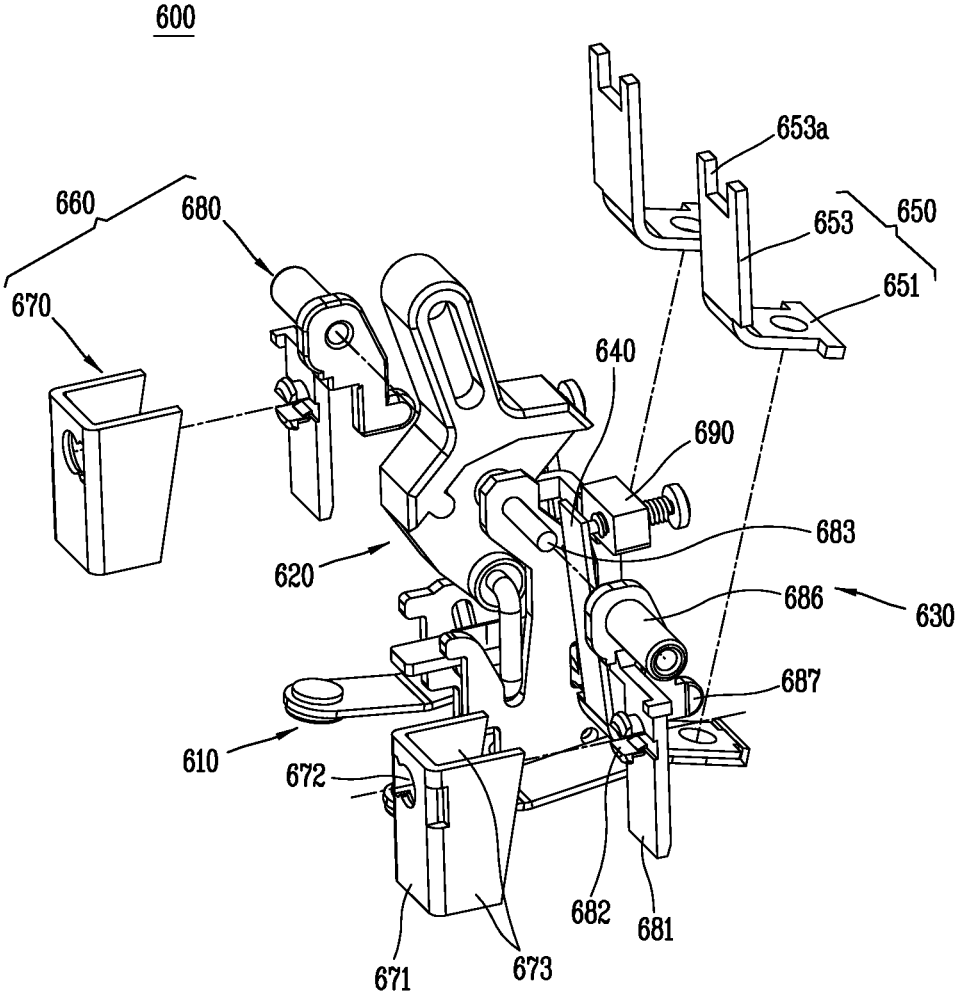
Figure 20:
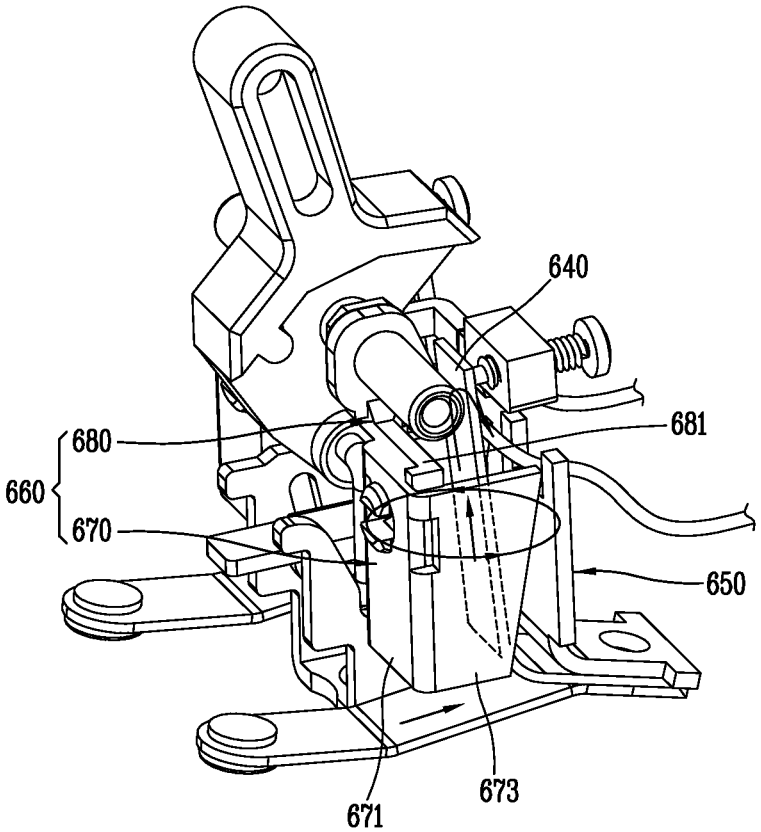
Figure 21:
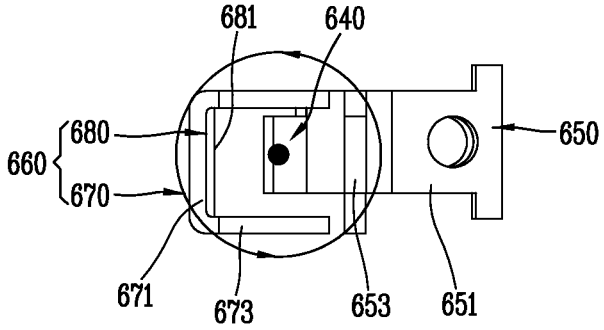
Figure 22:
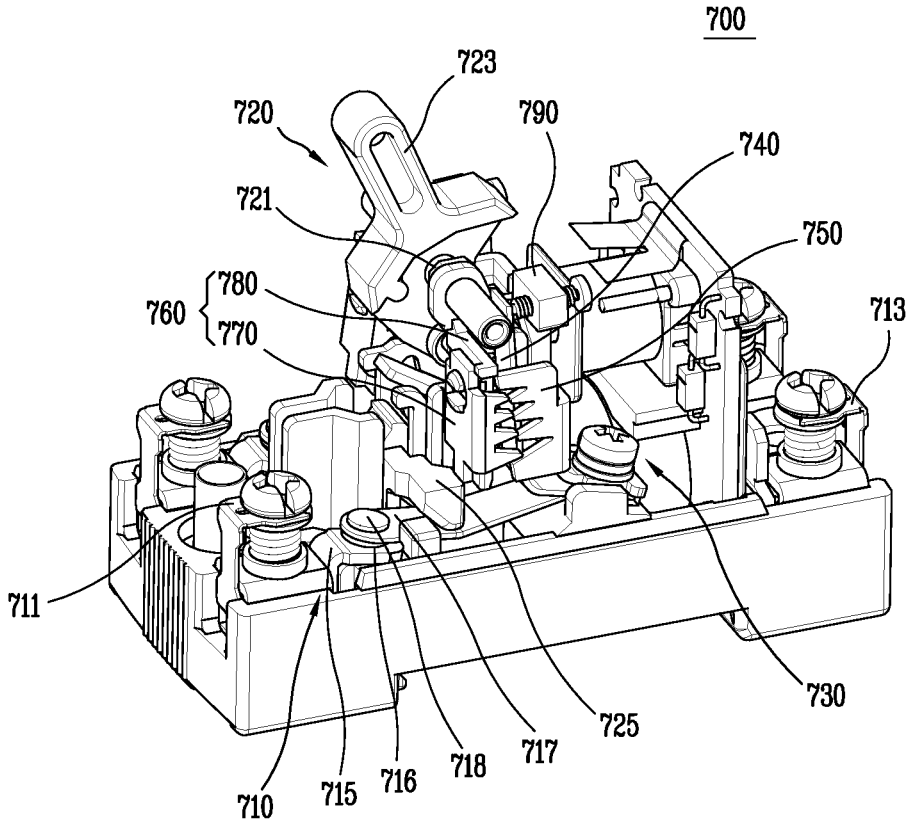
Figure 23:
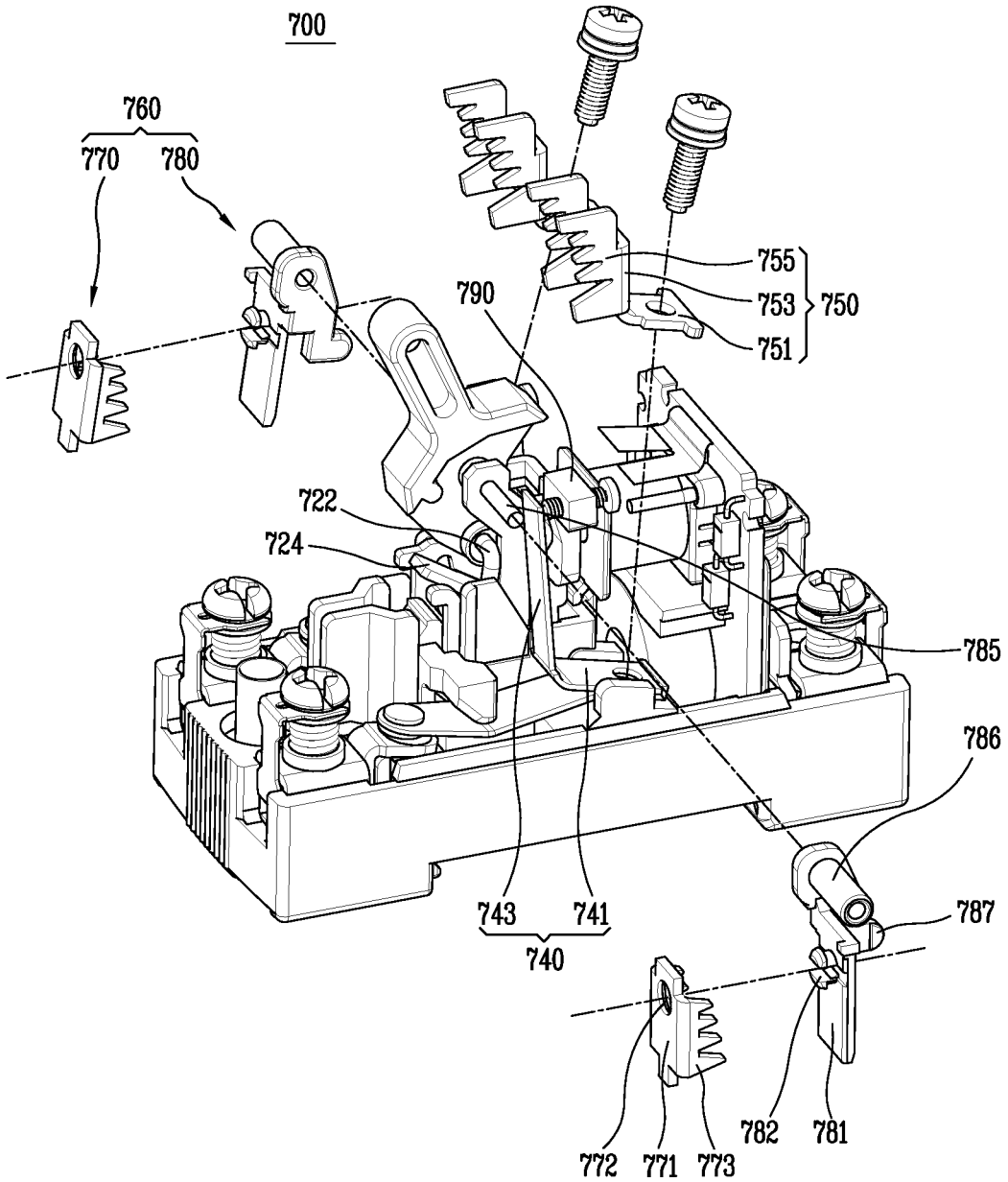
Figure 24:
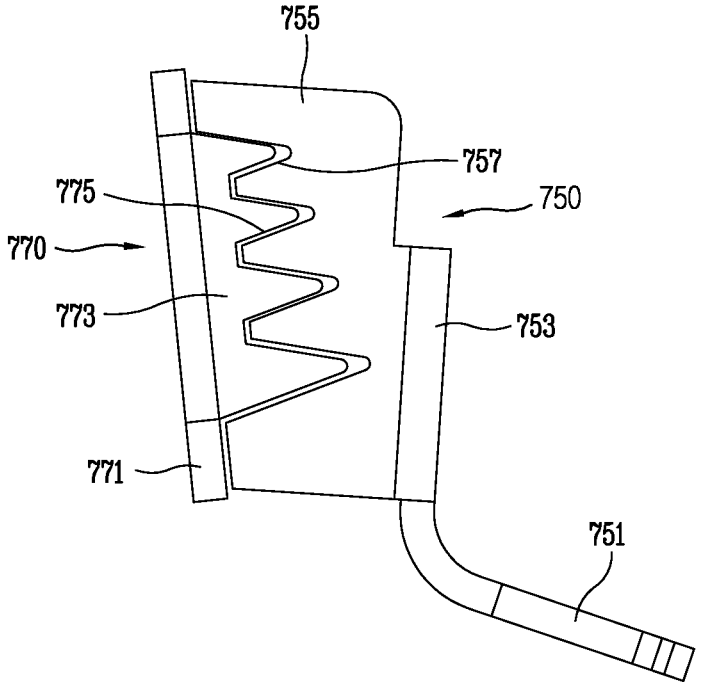
Figure 25:
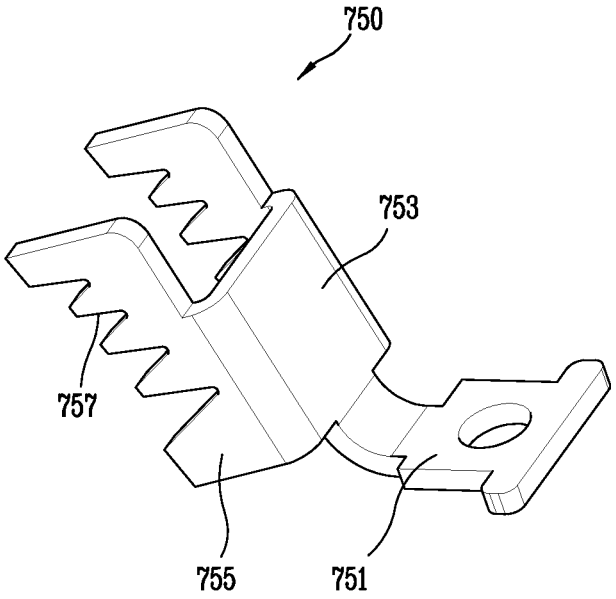
Figure 26:
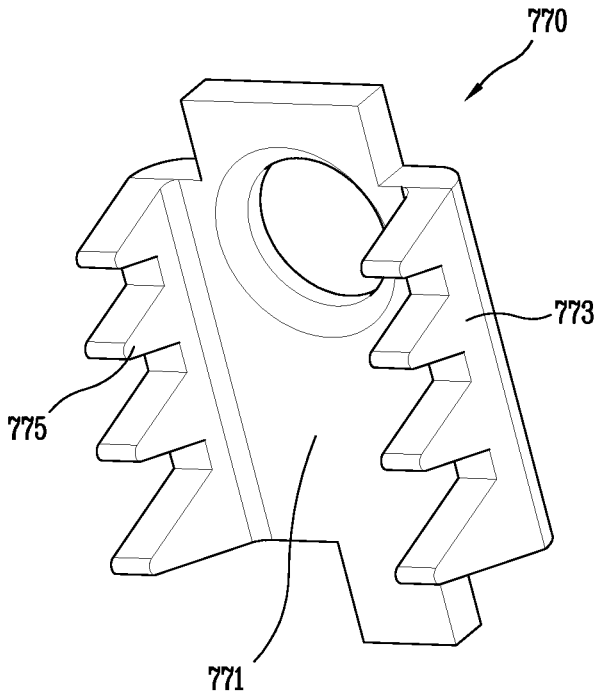
Figure 27:
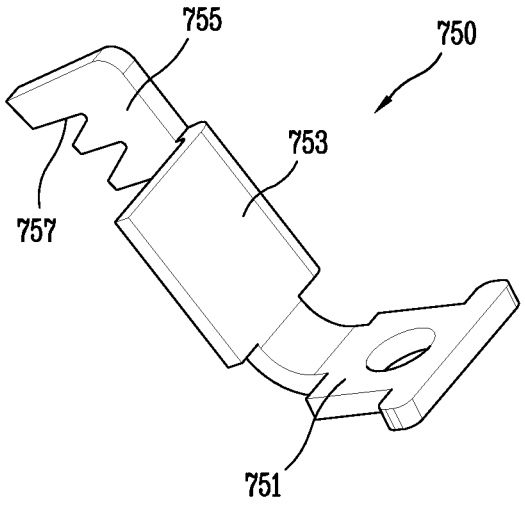
Figure 28:
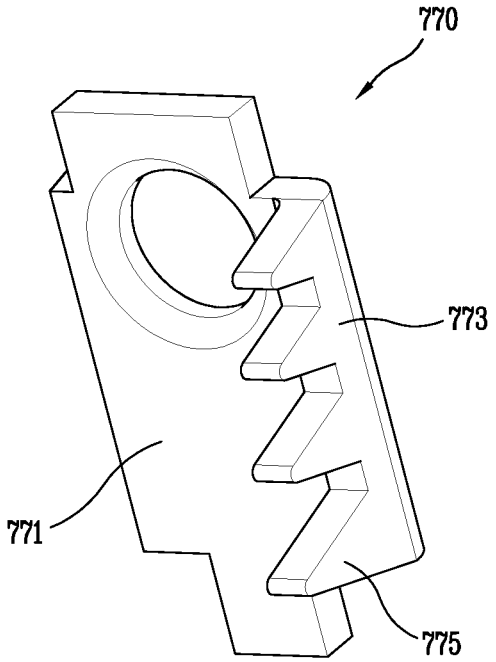
Figure 29:
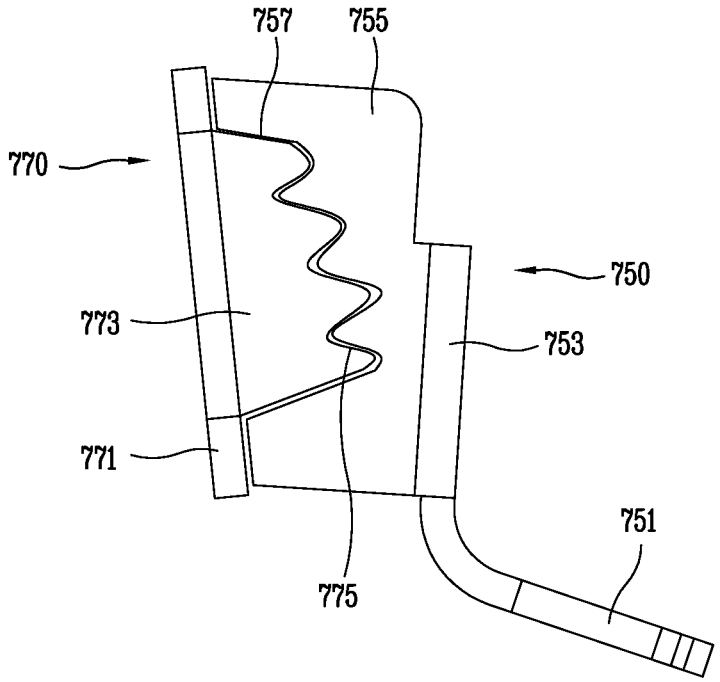
Figure 30:
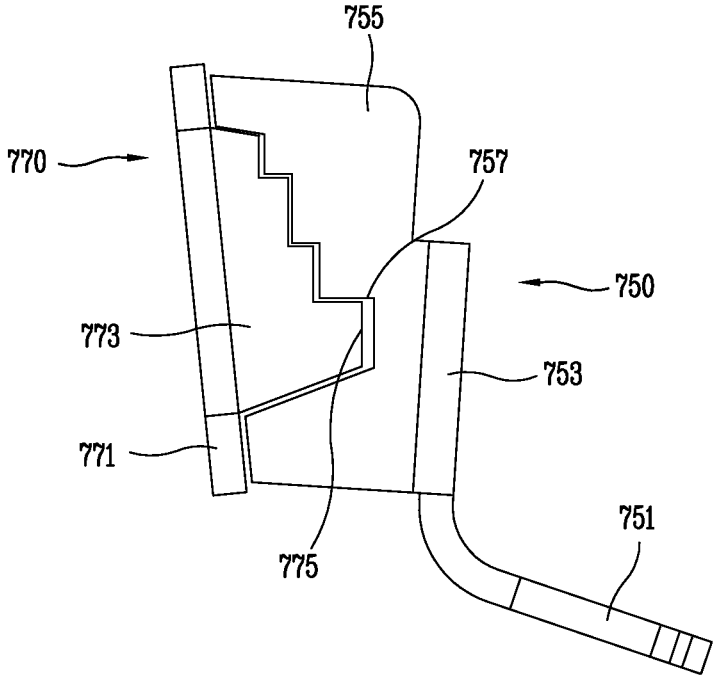
Figure 31:
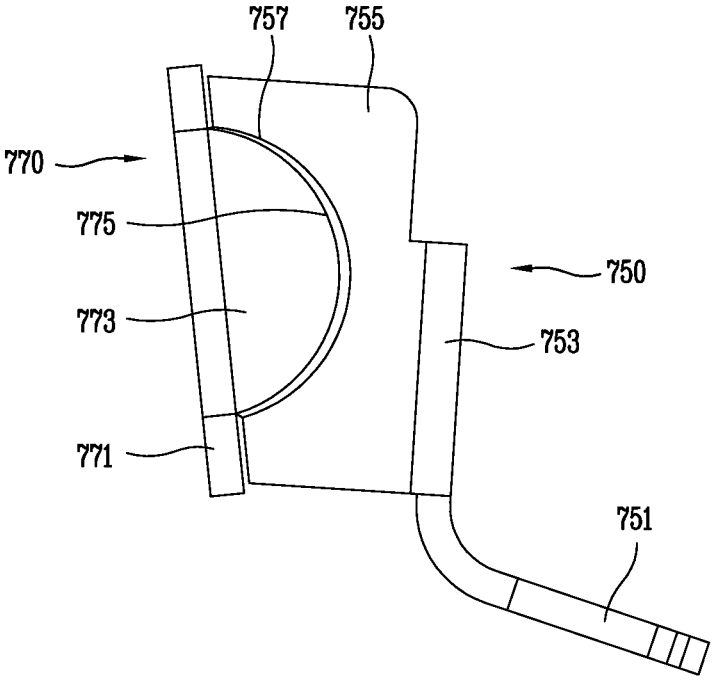
Figure 32:
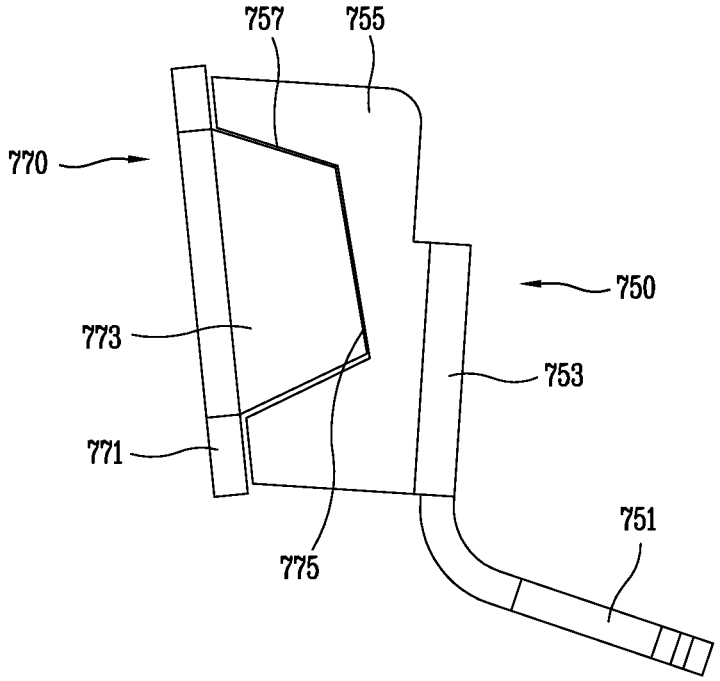
Figure 33:
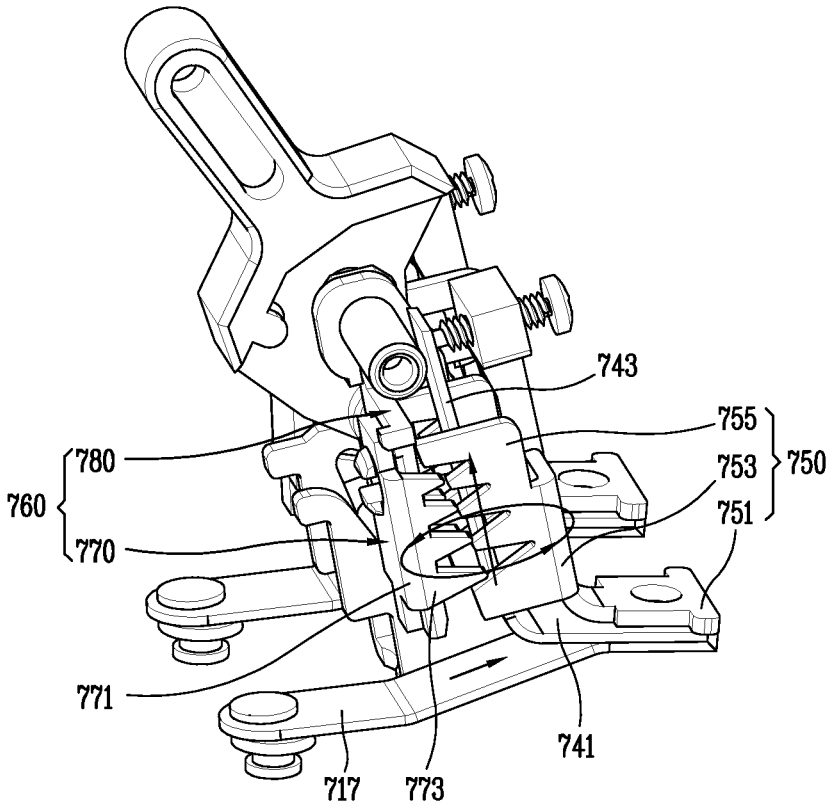
Figure 34:
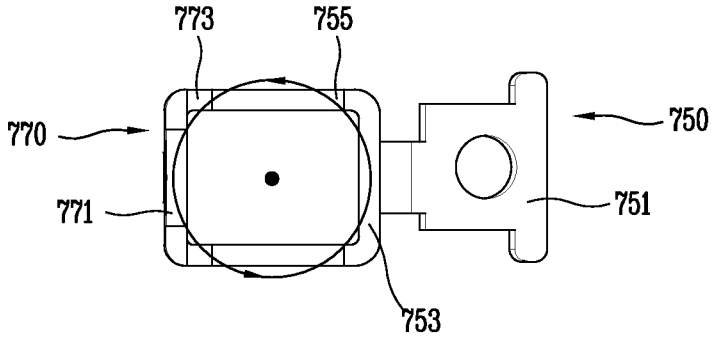
Figure 35:
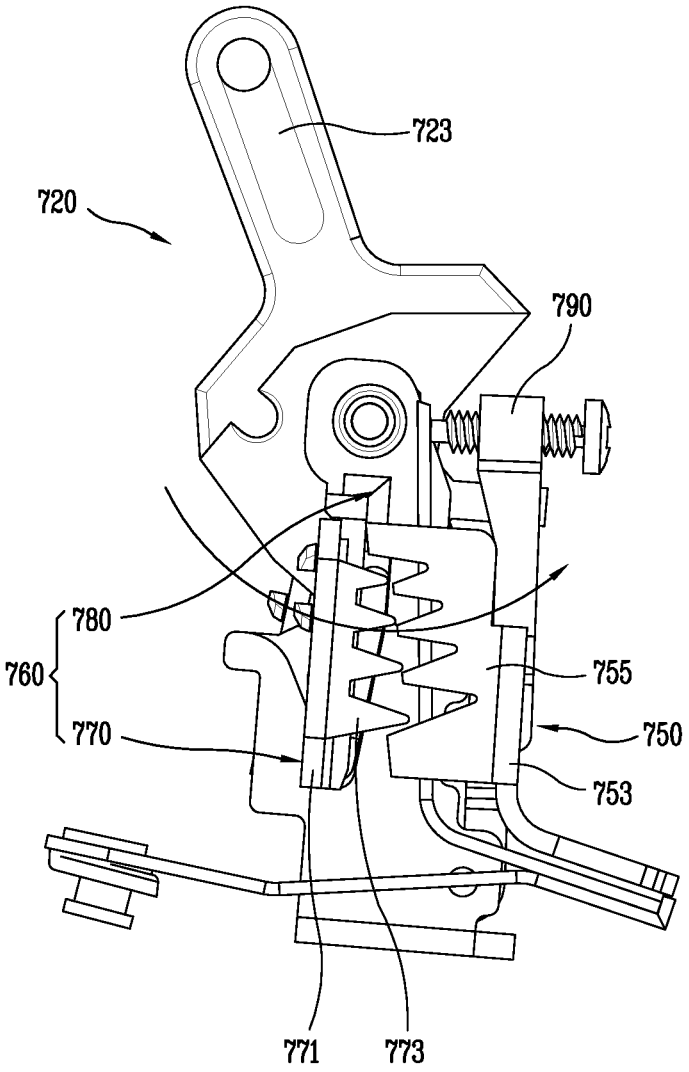
Figure 36:
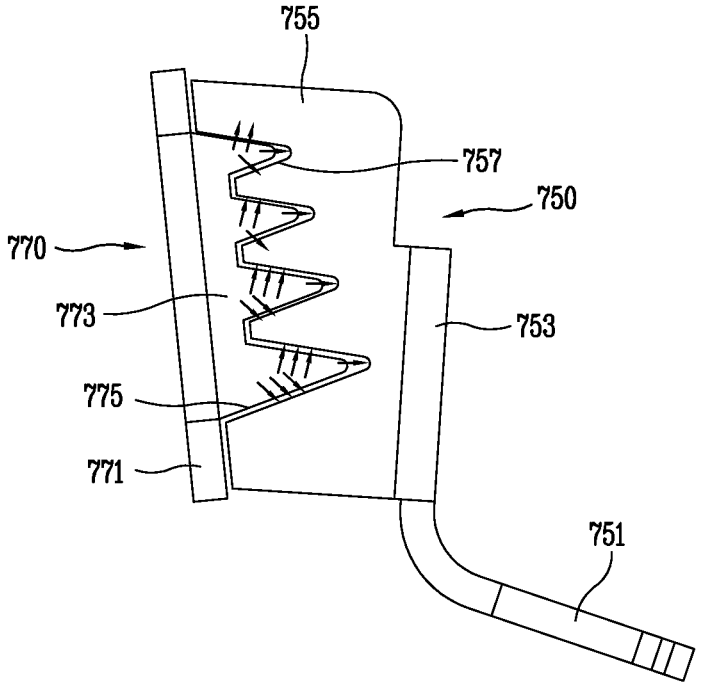

FIG. 18C is a view of a major part during the instant trip operation showing a position of the second armature portion attracted to the electromagnet of the circuit breaker according to the second embodiment of the present invention and a position of a cam surface portion of the first armature portion for pressing a trip bar; and FIG. 18D is a view showing a position of the second armature portion attracted to the electromagnet, a position of the cam surface portion of the first armature portion pressing a trip bar and a position of a handle in the circuit breaker according to the second embodiment of the present invention in a state that the instant trip operation is completed;

FIG. 19 is an exploded perspective view showing a configuration of an instant trip mechanism in a circuit breaker according to a third embodiment of the present invention;

FIG. 20 is a perspective view of a major part showing a flow of current and formation of a magnetic path loop formed in the vicinity of a bimetal in the circuit breaker according to the third embodiment of the present invention;

FIG. 21 is a plan view of the bimetal, the electromagnet and the second armature portion in FIG. 19;

FIG. 22 is a perspective view showing a configuration of a circuit breaker according to a fourth embodiment of the present invention, in a state that an upper cover is removed;

FIG. 23 is an partially exploded perspective view of the instant trip mechanism in the circuit breaker of FIG. 21;

FIG. 24 is a side view of an electromagnet and a second armature portion which approaches the electromagnet by a magnetic attractive force in the circuit breaker of FIG. 21;

FIG. 25 is a perspective view of an electromagnet showing a configuration of the electromagnet according to a first embodiment in the circuit breaker according to the fourth embodiment of the present invention;

FIG. 26 is a perspective view of a second armature portion showing a configuration of the second armature portion according to a first embodiment in the circuit breaker according to the fourth embodiment of the present invention;

FIG. 27 is a perspective view of an electromagnet showing a configuration of the electromagnet according to a second embodiment in the circuit breaker according to the fourth embodiment of the present invention;

FIG. 28 is a perspective view of a second armature portion showing a configuration of the second armature portion according to a second embodiment in the circuit breaker according to the fourth embodiment of the present invention;

FIG. 29 is a side view showing a configuration of an electromagnet and a second armature portion according to a third embodiment in the circuit breaker according to the fourth embodiment of the present invention;

FIG. 30 is a side view showing a configuration of an electromagnet and a second armature portion according to a fourth embodiment in the circuit breaker according to the fourth embodiment of the present invention;

FIG. 31 is a side view showing a configuration of an electromagnet and a second armature portion according to a fifth embodiment in the circuit breaker according to the fourth embodiment of the present invention;

FIG. 32 is a side view showing a configuration of an electromagnet and a second armature portion according to a sixth embodiment in the circuit breaker according to the fourth embodiment of the present invention;

FIG. 33 is a perspective view showing a flow of current of a bimetal in the circuit breaker according to the fourth embodiment of the present invention and a magnetic loop formed in the vicinity of the bimetal;

FIG. 34 is a plan view of the electromagnet and the second armature in the circuit breaker according to the fourth embodiment of the present invention showing formation of the magnetic loop of FIG. 32;

FIG. 35 is a side view of a major part in the circuit breaker according to the fourth embodiment of the present invention during an instant trip operation; and FIG. 36 is a side view of the electromagnet and the second armature portion showing a magnetic attractive force action of the electromagnet in the circuit breaker according to the fourth embodiment of the present invention during an instant trip operation.

DETAILED DESCRIPTION OF THE DISCLOSURE

Figure 1:
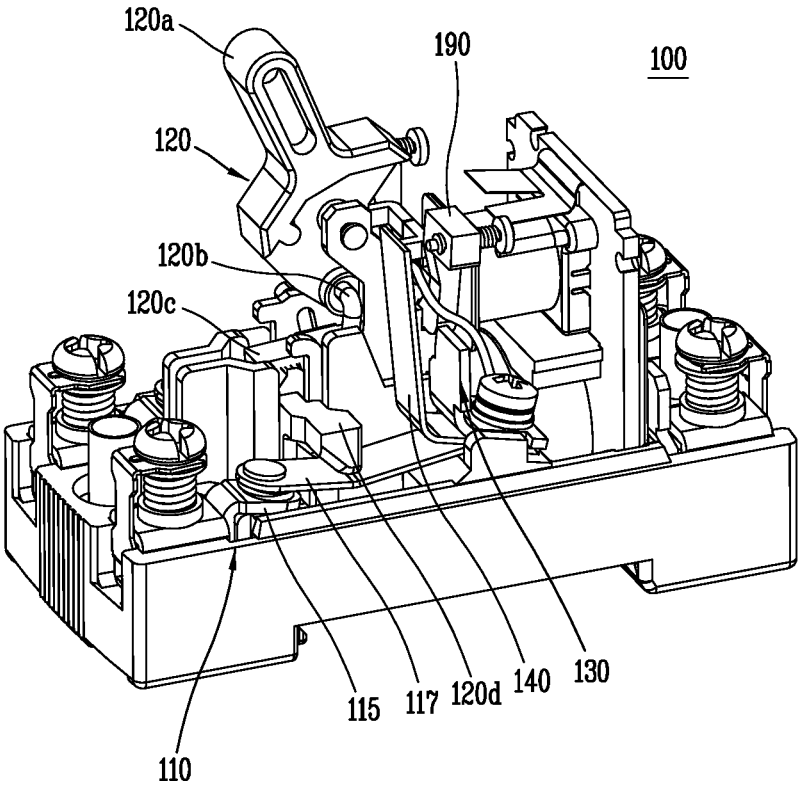
FIG. 1 RELATED ART
FIG. 1 is a perspective view showing a configuration of a circuit breaker according to the related art in a state that an upper cover is removed.
Figure 2:
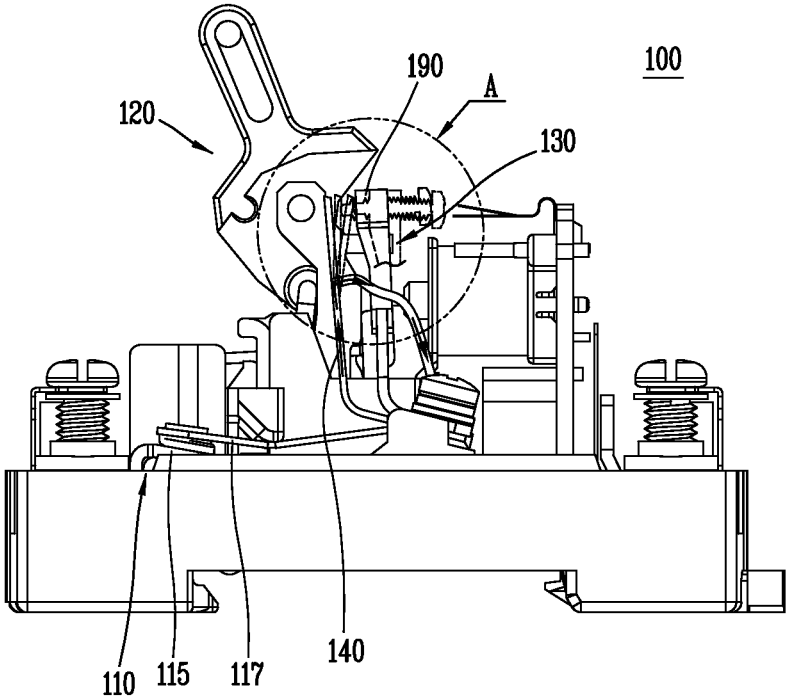
FIG. 2 RELATED ART
FIG. 2 is a side view showing a trip operation of the circuit breaker of FIG. 1.
Figure 3:
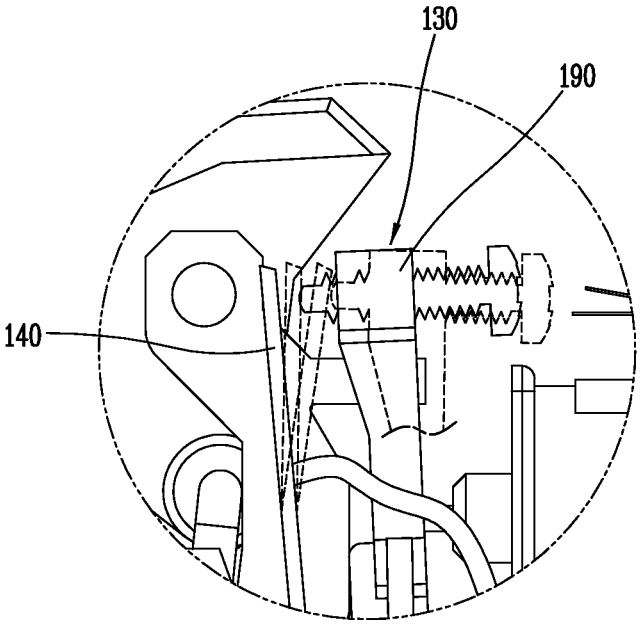
FIG. 3 RELATED ART
FIG. 3 is a partially enlarged view showing a trip operation of the circuit breaker of FIG. 1.
Figure 4:
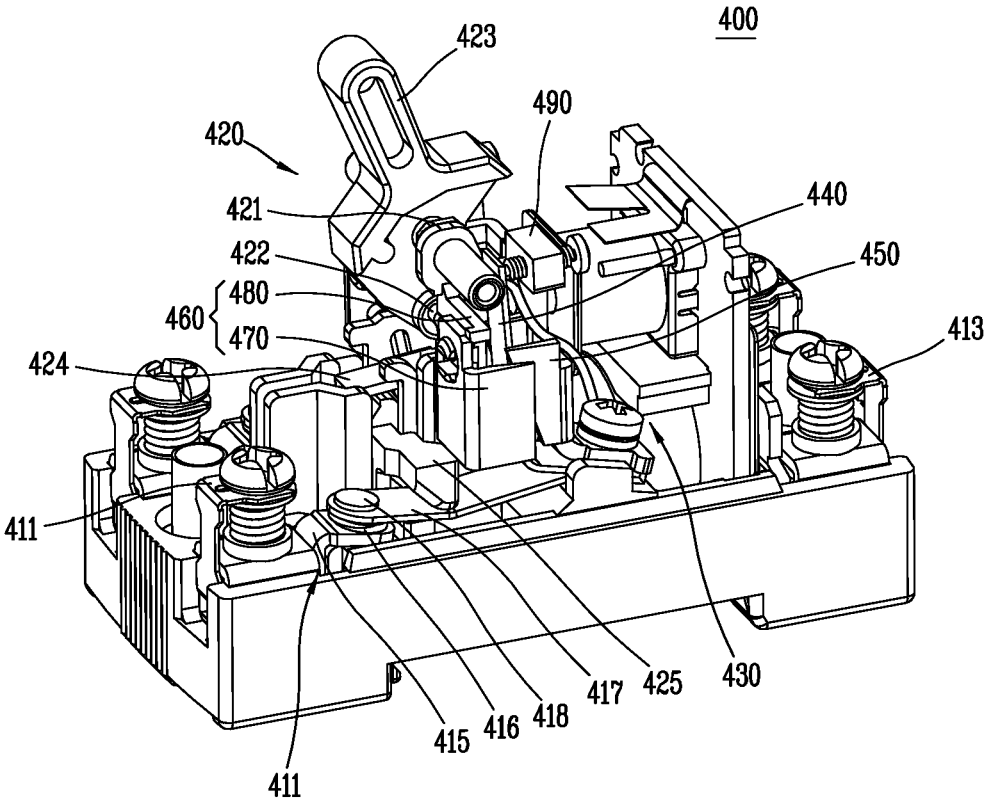
FIG. 4 is a perspective view showing a configuration of a circuit breaker according to a first embodiment of the present invention in a state that an upper cover is removed.
Figure 5:
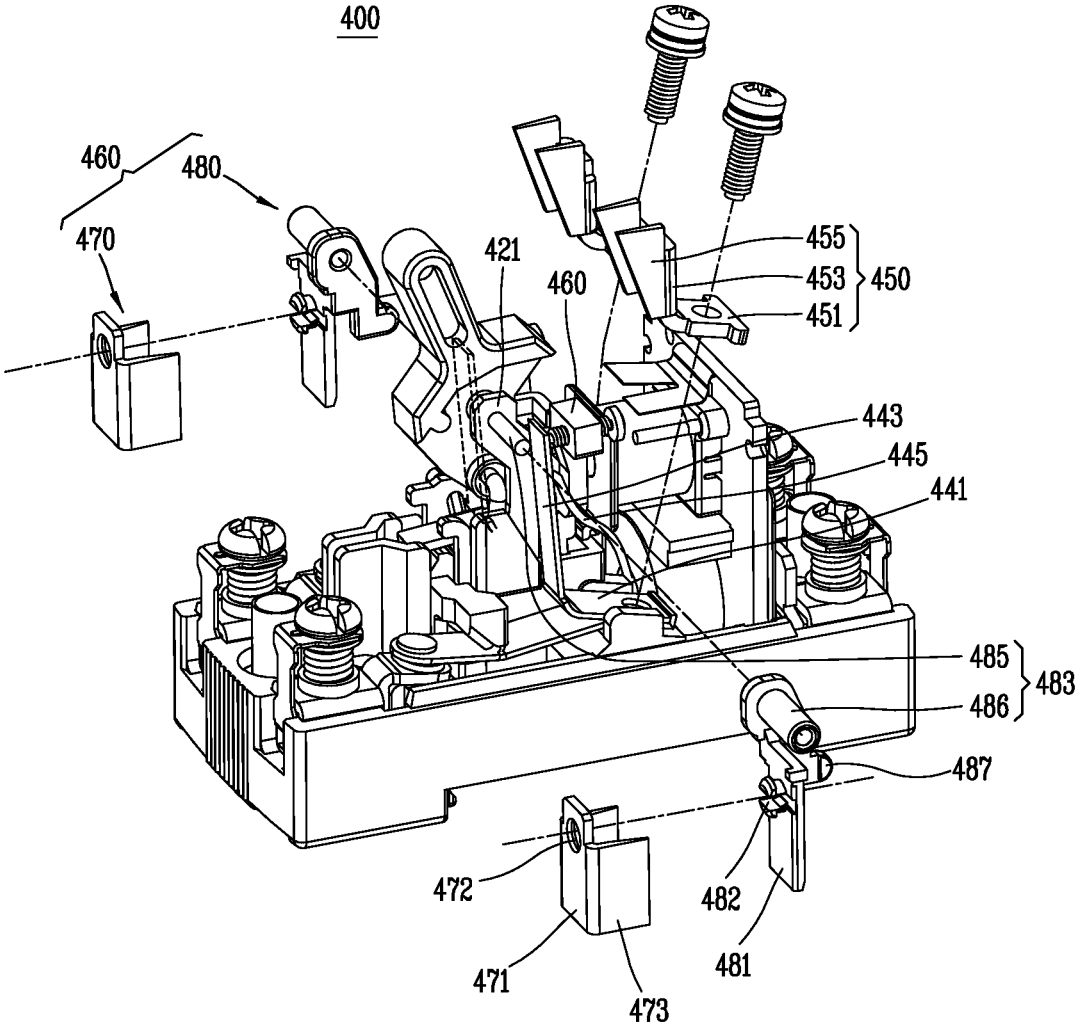
FIG. 5 is a partially exploded perspective view of the circuit breaker of FIG. 4, in which a trip mechanism is exploded.

Referring to FIGS. 4 and 5, a circuit breaker 400 according to a first embodiment of the present invention comprises a contact mechanism 410, a switching mechanism 420, a trip bar 490, and a trip mechanism 430.

The contact mechanism 410 may comprise a terminal part connected to an external electric power source side and an external electric load side and a switching contact part for opening or closing the circuit. That is, the contact mechanism 410 comprises a first terminal 411, a second terminal 413, a stationary contact arm 415, and a movable contact arm 417.

The first terminal 411 and the second terminal 413 in the contact mechanism 410 may be connected to either the electric power source side or the electric load side of the circuit. The first terminal 411 may be connected to the electric power source side, and the second terminal 413 may be connected to the electric load side. For example, the first terminal 411 and the second terminal 413 may be disposed at both ends of the contact mechanism 410, respectively.

A pair of stationary contact arms 415 may be provided for a 2-poles circuits.

Each stationary contact arm 415 may be fixed at a predetermined position in the contact mechanism 410. At this time, each stationary contact arm 415 may be electrically connected to the first terminal 411. Here, each stationary contact 415 may extend from the first terminal 411 so as to be integrally formed with each other. Each stationary contact 415 may comprise a stationary contact 416 disposed at an opposite end far from the first terminal 411.

The movable contact arms 417 may also be provided as a pair for a 2-poles circuits.

Each movable contact arm 417 may move to a circuit closing position in which the movable contact arm 417 contacts the corresponding stationary contact arm 415 in the contact mechanism 410 or to a circuit opening position in which the movable contact arm 417 is separated from the corresponding stationary contact arm 415. For example, each of the movable contact arms 417 may move up and down above the corresponding stationary contact arm 415. At this time, each movable contact arm 417 may be electrically connected to the second terminal 413. Each movable contact arm 417 may comprise a movable contact 418 disposed on the opposite side to the side near the second terminal 413. Here, each of the movable contacts 418 is positioned to face the corresponding stationary contact 416. For example, the movable contact 418 may be disposed at an upper position facing the stationary contact 416. In addition, each of the movable contacts 418 in the circuit closing position contacts the corresponding stationary contact 416, and each of the movable contacts 418 is separated from the corresponding stationary contact 416 in the circuit opening position.

Each of the movable contact arms 417 moves (descends) toward the corresponding stationary contact arm 415 so that each of the movable contacts 418 may contact the corresponding stationary contacts 416. Thus, the circuit between the first terminal 411 and the second terminal 413 may be connected (closed).

On the other hand, each of the movable contact arms 417 may move away from the corresponding stationary contact arm 415, so that each of the movable contacts 418 may be separated from the corresponding stationary contacts 416. Accordingly, the circuit between the first terminal 411 and the second terminal 413 may be broken (open).

The switching mechanism 420 is a mechanism for manually or automatically driving the contact mechanism 410 to the circuit opening position or the circuit closing position. That is, the switching mechanism 420 may transmit an operation force of a user to move the movable contact arm 417 toward the stationary contact arm 415 or to move the movable contact arm 417 to be separated from the stationary contact arm 415.

The switching mechanism 420 may also perform an operation (trip operation) to drive the movable contact arm 417 so as to automatically break the circuit in accordance with a trigger operation of the trip mechanism 430 in response to the occurrence of a fault current on the circuit.

This switching mechanism 420 may comprise a side plate 421, a handle 423, a U-shaped connecting pin 422 (also refer to FIG. 18D), a lever 424, a cross bar 425, and a compression spring (not shown).

The side plate 421 may be configured as a pair of iron plates for supporting the components constituting the switching mechanism 420 and the components constituting the switching mechanism 420 may be installed between both side plates 421.

The side plate 421 has a portion that extends upward to support the handle 423 and a lower portion that supports the remaining components that are included in the switching mechanism 420.

The handle 423 provides the user with a means for a manual switching operation in the switching mechanism 420. Here, a central shaft of the handle 423 may be supported by the side plate 421. Thus, the handle 423 may be rotated within a predetermined range by a user's operation.

The U-shaped connecting pin 422 is an element that is connected to a lower portion of the handle 423 at its upper end and connected to the lever 424 at its lower end to connect and drive the handle 423 and the lever 424 for interlocking.

The lever 424 is connected to a lower end of the U-shaped connecting pin 422 at a substantially middle portion in a longitudinal direction and has one end which is restrained or released by a trip bar 490 described later.

The cross bar 425 is provided so as to cross a pair of movable contact arms 417 for opening and closing a 2-poles circuits and has a lying U-shaped support portion for supporting the movable contact arm 417 interposed with both ends thereof.

A compression spring (not shown) is installed between the cross bar 425 and a bottom surface of the enclosure of the circuit breaker 400 and elastically bias the movable contact arm 417 to move to the circuit opening position in which the movable contact arm 417 is separated from the corresponding stationary contact arm 415 via the cross bar 425.

When the circuit breaker 400 trips, the compression spring becomes a driving source for moving the movable contact arm 417 via the cross bar 425.

The trip bar 490 is a component having an alphabet "Y" shape and has an upper branch portion divided into two fork portions and a lower end supported by a support shaft (not shown) to be rotatable.

Both ends of the branch portion are provided with adjusting screws for adjusting a gap from the bimetal 440 described later.

The trip bar 490 has a support groove portion between both forks of the upper branch portion for latching or releasing one end of the lever 424.

Thus, the trip bar 490 is rotatable to a first position for latching one end of the lever 424 and a second position for releasing one end of the lever 424.

When a fault current occurs in the circuit, the trip mechanism 430 may trigger the trip mechanism 420 to trip in response thereto. That is, the trip mechanism 430 drives the trip bar 490 to rotate to the second position in response to the fault current on the circuit.

The trip mechanism 430 may comprise a thermal trip mechanism and an instant trip mechanism.

Here, the thermal trip mechanism comprises a bimetal 440.

As illustrated, the bimetal 440 is connected to the circuit together with the movable contact arm 417 and the electromagnet 450 and is bent by heat due to a fault current on the circuit.

The bimetal 440 is also a means for providing a flowing path of a current in the circuit and comprises an input portion 441 and an output portion 443 as shown in FIG. 5.

The bimetal 440 is configured as a bimetal strip having a substantially L shape in an alphabet, and has the input portion 441 as a lower horizontal portion and the output portion 443 as a vertical portion extending upward from the horizontal portion.

In the bimetal 440, the input portion 441 is a portion through which a current flows in, and the output portion 443 is a portion through which a current flows out and also provides a mechanical output that is bent in response to a fault current on the circuit.

Figure 11A:
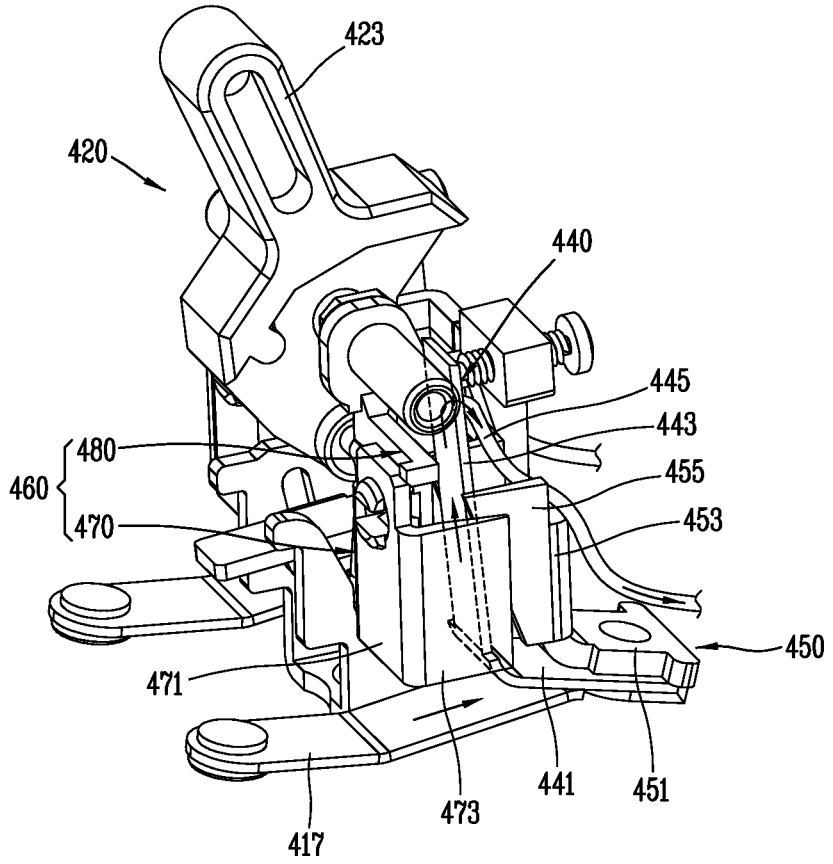
FIGS. 11A and 11B show a flow of current and formation of a magnetic loop in the circuit breaker according to the first embodiment of the present invention.
Figure 11B:
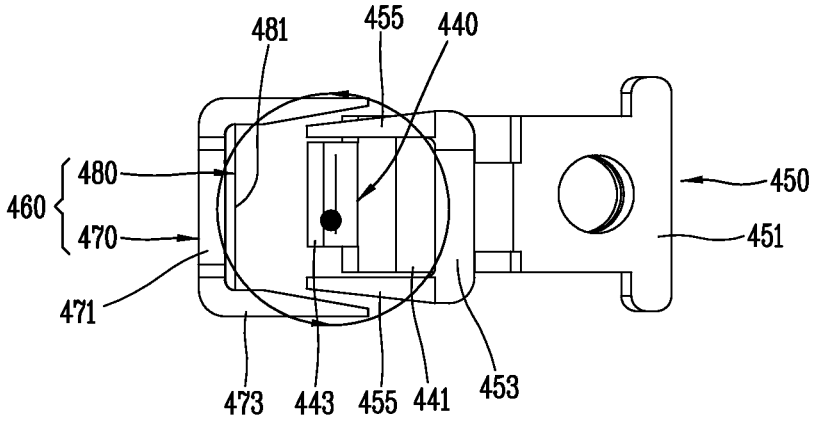

Since the output portion 443 of the bimetal 440 is also a current path, a magnetic field is generated around the output portion 443 (see FIG. 11B).

In FIG. 5, reference numeral 445 designates a conductive wire which provides a current path so that a current flowing from the bimetal 440 flows toward the second terminal 413.

The instant trip mechanism comprises a pair of electromagnets 450 and a pair of armature assemblies 460 corresponding to the 2-poles circuits.

The pair of electromagnets 450 are provided to face the pair of armature assemblies 460 and apply a magnetic attractive force to the pair of armature assemblies 460 in response to the fault current on the circuit for which an instant trip is required.

Figure 6A:
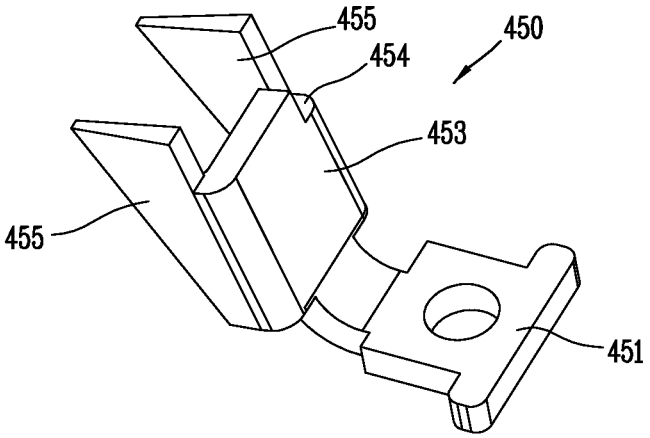
FIG. 6A is a perspective view showing a configuration of an electromagnet for one pole in a circuit breaker according to the first embodiment of the present invention.
Figure 6B:
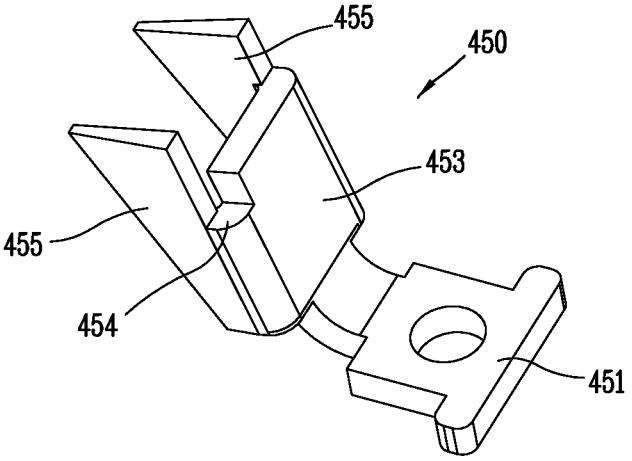
FIG. 6B is a perspective view showing a configuration of an electromagnet for the other pole in the circuit breaker according to the first embodiment of the present invention.

As illustrated in FIGS. 6A and 6B, each of the pair of electromagnets 450 may comprise a fixing portion 451, a first electromagnet portion 453, and at least one second electromagnet portion 455.

The fixing portion 451 may be a portion for fixing the electromagnet 450 and may be fixed to the bottom surface of the enclosure of the circuit breaker 400 by a fixing screw. At this time, the fixing portion 451 may be fixed together with the input portion 441 of the bimetal 440 and the end of the movable contact arm 417. The fixing portion 451 may be fixed to the bottom surface of the enclosure of the circuit breaker 400 in a state that the fixing portion 451 is stacked on the input portion 441 of the bimetal 440 and the movable contact arm 417.

The first electromagnet portion 453 and the second electromagnet portion 455 may be magnetized by a current on the circuit. Therefore, the first electromagnet portion 453 and the second electromagnet portion 455 may generate a magnetic attractive force toward the armature assembly 460.

The first electromagnet portion 453 may be connected to the fixing portion 451. The first electromagnet portion 453 may extend from the fixing portion 451. Here, the first electromagnet portion 453 may be formed by bending from the fixing portion 451.

Further, the first electromagnet portion 453 may have a cutout recess portion 454 provided at one side edge to guide a conductive wire (see reference numeral 443 in FIG. 5) as shown in FIGS. 6A and 6B. Here, a position of the cutout recess portion 454 in the first electromagnet portion 453 may be determined to be different depending on the position of the first electromagnet portion 453 with respect to the switching mechanism 420.

The second electromagnet portion 455 may be connected to the first electromagnet portion 453. At this time, the second electromagnet portion 455 may be connected to an edge area of the first electromagnet portion 453. Here, the second electromagnet portion 455 may be connected to at least one of both sides of the first electromagnet portion 453. The second electromagnet portion 455 may extend from the first electromagnet portion 453 toward the armature assembly 460. Here, the second electromagnet portion 455 may be formed to be bent from the first electromagnet portion 453. The second electromagnet portion 455 may extend to outside of the armature assembly 460 or extend to inside of the armature assembly 460. In addition, the second electromagnet portion 455 may pass through the conductive wire 445 of the bimetal 440 from the outside.

At this time, a length of the first electromagnet portion 453 may be defined along the direction extending from the fixing portion 451. Correspondingly, a length of the second electromagnet portion 455 may be defined along the same direction as the length of the first electromagnet portion 453. For example, the length of the second electromagnet portion 455 may exceed the length of the first electromagnet portion 453 as shown in FIGS. 6A and 6B, but is not limited thereto. That is, the length of the second electromagnet portion 455 may be less than or equal to the length of the first electromagnet portion 453. On the other hand, a width of the second electromagnet portion 455 may be defined as a direction opposite to the armature assembly 460 from the first electromagnet portion 453. For example, the width of the second electromagnet portion 455 may be narrower toward the fixing portion 451 as shown in FIGS. 6A and 6B, but is not limited thereto. That is, the width of the second electromagnet portion 455 may be larger toward the fixing portion 451 and may be constant regardless of the distance from the fixing portion 451. On the other hand, a thickness of the second electromagnet portion 455 may be defined as a direction perpendicular to the direction facing the armature assembly 460 from the first electromagnet portion 453. For example, the thickness of the second electromagnet portion 455 may be thinner as it is away from the first electromagnet portion 453 or closer to the armature assembly 460 as shown in FIGS. 6A and 6B, but is not limited thereto. That is, the thickness of the second electromagnet portion 455 may be constant regardless of the distance from the first electromagnet portion 453 or the armature assembly 460.

The pair of armature assemblies 460 are provided to correspond to the two poles of the circuits and are movable to a position at in which pressure is applied to the trip bar 490 to rotate to the second position.

The armature assembly 460 may be moved by a magnetic force of the electromagnet 450. Here, the armature assembly 460 may be rotated by a magnetic force of the electromagnet 450. To this end, the armature assembly 460 may be rotatably supported by the switching mechanism 420. Here, the magnetic force is a magnetic attractive force. The armature assembly 460 may approach the electromagnet 450 by the magnetic attractive force of the electromagnet 450. Through this, the armature assembly 460 may apply pressure to the trip bar 490.

Referring to FIG. 5, each of the pair of armature assemblies 460 may comprise a first armature portion 480, a second armature portion 470, and a coupling portion 481.

The first armature portion 480 is pivotally supported and rotatable. That is, the first armature portion 480 is rotatably supported by a rotary shaft 485 provided so as to pass through the side plate 421 and the handle 423 of the switching mechanism 420.

As illustrated in FIG. 5, the first armature portion 480 comprises a coupling portion 481, a coupling protrusion 482, a shaft receiving tubular portion 486, and a cam surface portion 487.

A function of the first armature portion 480 is to rotate the second armature portion 470 and push the trip bar 490.

Accordingly, the first armature portion 480 may be formed by molding a synthetic resin material, not a steel material, according to a preferred embodiment.

The coupling portion 481 is a means for coupling the first armature portion 480 and the second armature portion 470, and may be configured with a piece made of a plate-like synthetic resin material.

The coupling protrusion 482 may be integrally formed with the coupling portion 481 and extend from a plate surface of the coupling portion 481.

The coupling protrusion 482 is inserted into a coupling hole portion 472 formed corresponding to the second armature portion 470 and has two divided elastic configurations that may be spread out or puckered according to a preferred embodiment.

The coupling protrusion 482 may be puckered when inserted into the coupling hole portion 472 of the second armature portion 470 and may be spread when inserting is completed, firmly maintaining a coupling state of the first armature portion 480 and the second armature portion 470.

The shaft receiving tubular portion 486 is formed to extend from an upper portion of the coupling portion 481 and is formed as a hollow tube portion which is hollow inside so as to receive the rotary shaft 485.

Referring to FIG. 5, since the rotation direction of the first armature portion 480 and the extending direction of the rotary shaft 485 are perpendicular to each other, the shaft receiving tubular portion 486 extends to correspond to the rotary shaft 485 from a central portion of the plane extending from an upper portion of the coupling portion 481 at a right angle to a flat surface of the coupling portion 481.

The cam surface portion 487 of the first armature portion 480 is a portion that presses the trip bar 490 and is configured as a curved portion protruding from the flat surface of the coupling portion 481 toward the trip bar 490 according to a preferred embodiment.

A portion of the trip bar 490 to which the cam surface portion 487 (587 in FIG. 18B) contacts is a corresponding one of the two branch portions as illustrated in FIG. 18B.

The second armature portion 470 is coupled with the first armature portion 480 so as to be rotatable together and is disposed to face the corresponding electromagnet 450.

The second armature portion 470 may be disposed on the opposite side of the electromagnet 450 with respect to the bimetal 440. The second armature portion 470 can be moved toward the electromagnet 450 by a magnetic attractive force of the electromagnet 450.

The second armature portion 470 may be preferably formed of iron so as to be attracted by the magnetic attractive force from the electromagnet 450.

As illustrated in FIG. 11B, the second armature portion 470 is installed to surround the bimetal 440 together with the facing electromagnet 450 so as to form a closed loop of a magnetic path together with the corresponding electromagnet 450.

Figure 7:
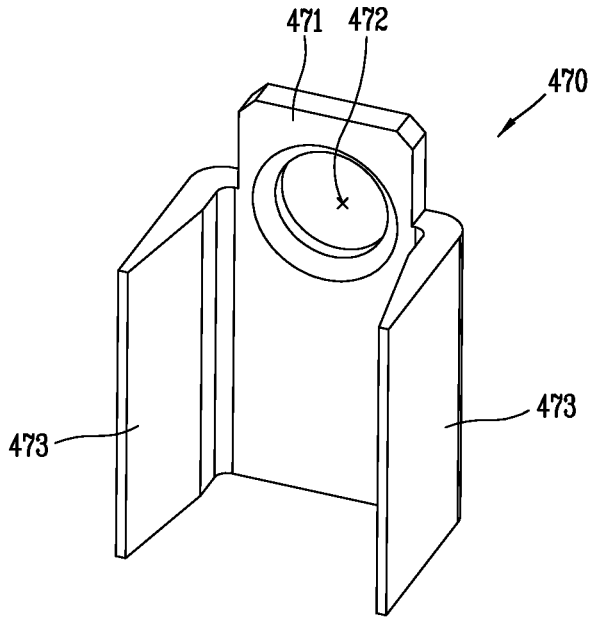
FIG. 7 is a perspective view showing a configuration of a second armature portion of the circuit breaker according to the first embodiment of the present invention.

As illustrated in FIG. 7, each of the second armature portions 470 comprises a base portion 471 and at least one wing portion 473.

According to the embodiment shown in FIG. 7, the wing portion 473 is configured as a pair of wing portions extending from both sides of the base portion 471.

As illustrated in FIGS. 9 to 12, the base portion 471 is disposed so as to face the corresponding electromagnet 450.

As illustrated in FIG. 7, the base portion 471 has a coupling hole portion 472 for allowing the coupling protrusion 482 of the first armature portion 480 to be inserted thereinto.

The base portion 471 may be disposed parallel to the first electromagnet portion 453 of the electromagnet 450. At this time, the base portion 471 may be disposed on the opposite side of the first electromagnet portion 453 with respect to the output portion 443 of the bimetal 440 as shown in FIG. 11A or 11B.

The wing portion 473 extends from the base portion 471 toward the corresponding electromagnet 450.

The wing portion 473 may be formed by bending the base portion 471. For example, the wing portion 473 may extend to outside of the first electromagnet portion 453 or may extend to inside of the first electromagnet portion 453. The wing portion 473 may pass through the outside of the output portion 443 of the bimetal 440.

Figure 9:
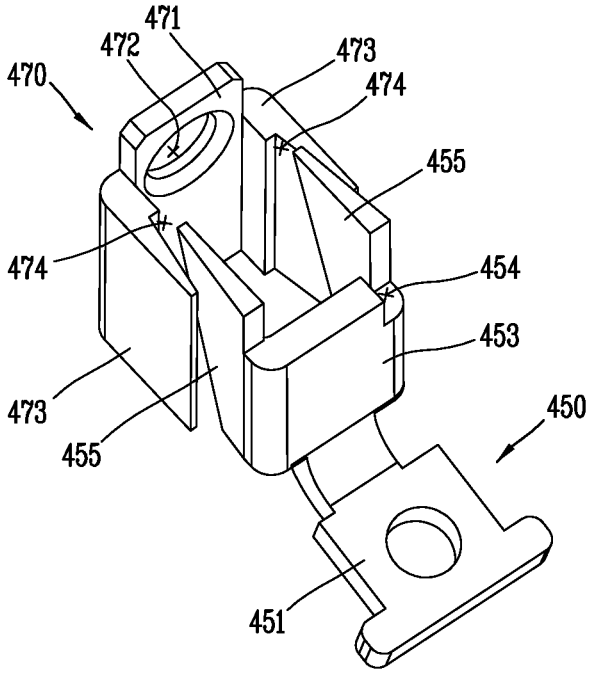
FIG. 9 is a perspective view of an electromagnet and a second armature portion showing a configuration of a second armature portion according to another embodiment in the circuit breaker according to the first embodiment of the present invention.

According to a preferred embodiment, a thickness of the wing portion 473 may vary along a length direction of the wing portion 473 as shown in FIGS. 7 and 9. That is, for example, the thickness of the wing portion 473 may be made thinner as it is farther from the base portion 471 and closer to the first electromagnet portion 453 as shown in FIGS. 7 and 9.

The intensity of a magnetic force between the second armature portion 470 and the electromagnet 450 can be determined according to an area where the second armature portion 470 and the electromagnet 450 face each other. That is, as the area where the second armature portion 470 and the electromagnet 450 face each other is increased, an operation effect of the magnetic attractive force of the electromagnet 450 acting on the second armature portion 470 may be increased.

Figure 8:
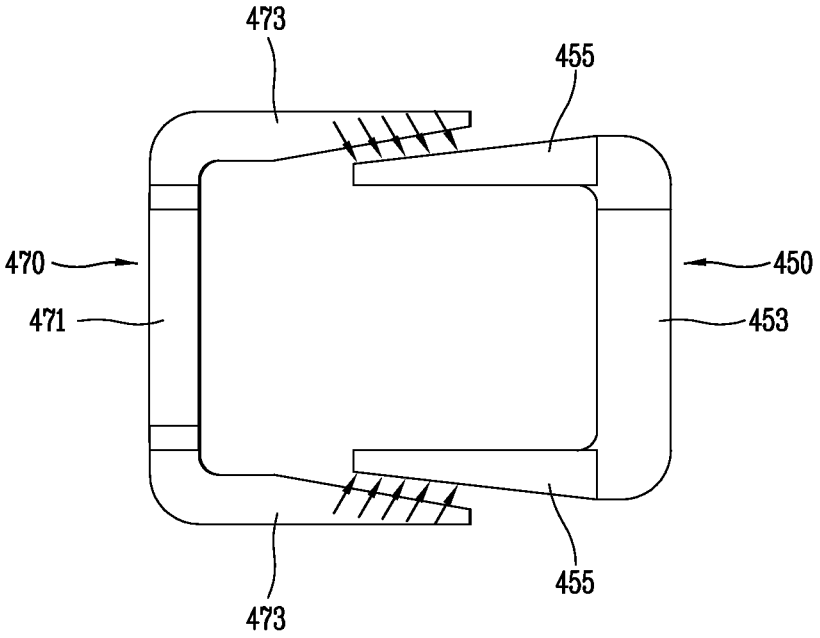
FIG. 8 is a plan view of a first embodiment of an electromagnet and a second armature portion showing an electromagnetic attracting operation of an electromagnet with respect to a second armature portion of the circuit breaker according to the first embodiment of the present invention.
Figure 10:
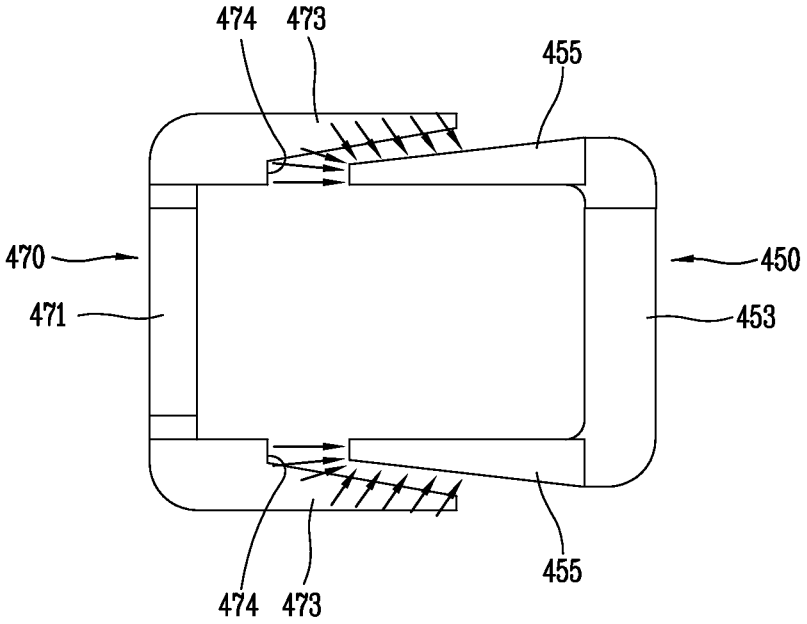
FIG. 10 is a plan view showing a magnetically attracting action of the electromagnet and the second armature portion of FIG. 9.

Therefore, in addition to the magnetic attractive force applied by the first electromagnet portion 453 of the electromagnet 450 to the base portion 471 of the facing second armature portion 470, the electromagnet 450 acting on the second armature portion 470, the second electromagnet portion 455 and the wing portion 473 can be overlapped each other as shown in FIGS. 8 and 10 in order to increase the effect of the magnetic attractive force of the second electromagnet portion 455. That is, according to an aspect of the present invention, the second armature portion 470 is installed so as to at least partially overlap the facing electromagnet 450 so as to increase the area facing each other.

Also, as illustrated in FIGS. 8 and 10, as the second electromagnet portion 455 extends from the inner side of the wing portion 473 to face the base portion 471, the second electromagnet portion 455 may be closer to the output portion 443 than the wing portion 473 but the present invention is not limited thereto. That is, the second electromagnet portion 455 may extend to outside of the wing portion 473 so that the wing portion 473 may be closer to the output portion 443 than the second electromagnet portion 455.

Further, the second electromagnet portion 455 and the wing portion 473 may have shapes corresponding to each other.

According to one embodiment, the second electromagnet portion 455 and the wing portion 473 may be configured such that mutually opposing planes are parallel to one another.

According to a preferred aspect of the present invention, mutually facing surfaces of the wing portion 473 of the second armature portion 470 and the electromagnet 450 are formed as inclined surfaces so that a magnetic attractive force effect may be increased by increasing the area facing each other.

According to one embodiment, as shown in FIG. 8, the second electromagnet portion 455 may have an inclined surface corresponding to the wing portion 473 and the wing portion 473 may have an inclined surface corresponding to the second electromagnet portion 455. Therefore, compared with that the mutually facing surfaces of the second electromagnet portion 455 and the wing portion 473 are formed as flat surfaces, as shown in FIG. 8, the area in which the second electromagnet portion 455 and the wing portion 473 face each other is increased so that an operating effect (attractive force) of the magnetic attractive force acting on the second armature portion 470 by the electromagnet 450 may be increased.

According to a preferred aspect of the present invention, in order to increase the facing area of the electromagnet 450 so as to increase the effect of the magnetic attractive force acting on the second armature portion 470, the wing portion 473 of the second armature portion 470 comprises a stepped portion 474 formed in a shape corresponding to an end surface of the second electromagnet portion 455.

According to another embodiment, either the second electromagnet portion 455 and the wing portion 473 may comprise the step portion and the step portion may be formed to correspond to a shape of an end surface of any one of the second electromagnet portion 455 and the wing portion 473.

As a result, as illustrated in FIG. 10, the second electromagnet portion 455 may apply a magnetic attractive force to the wing portion 473. As a result, the area in which the second electromagnet portion 455 and the wing portion 473 face each other is expanded and the effect of the magnetic attractive force from the electromagnet 450 acting on the second armature portion 470 is increased.

The operation of the circuit breaker 400 configured as described above will be described with reference mainly to FIGS. 11A, 11B, and 12.

First, when a fault current such as an over current or an electric shortage current is generated in a circuit to which the circuit breaker 400 is connected, as shown in FIGS. 11A and 11B, the fault current may flow by way of the input portion 441 of the bimetal 440 from the movable contact arm 417 and then through the output portion 443 of the bimetal 440 and then to the conductive wire 445. Therefore, a magnetic field may be generated around a current path at the output portion 443 of the bimetal 440. A magnetic path may be formed in the form of a closed loop through the electromagnet 450 and the armature assembly 460 disposed around the bimetal 440 may be formed as shown in FIG. 11.

Figure 12:
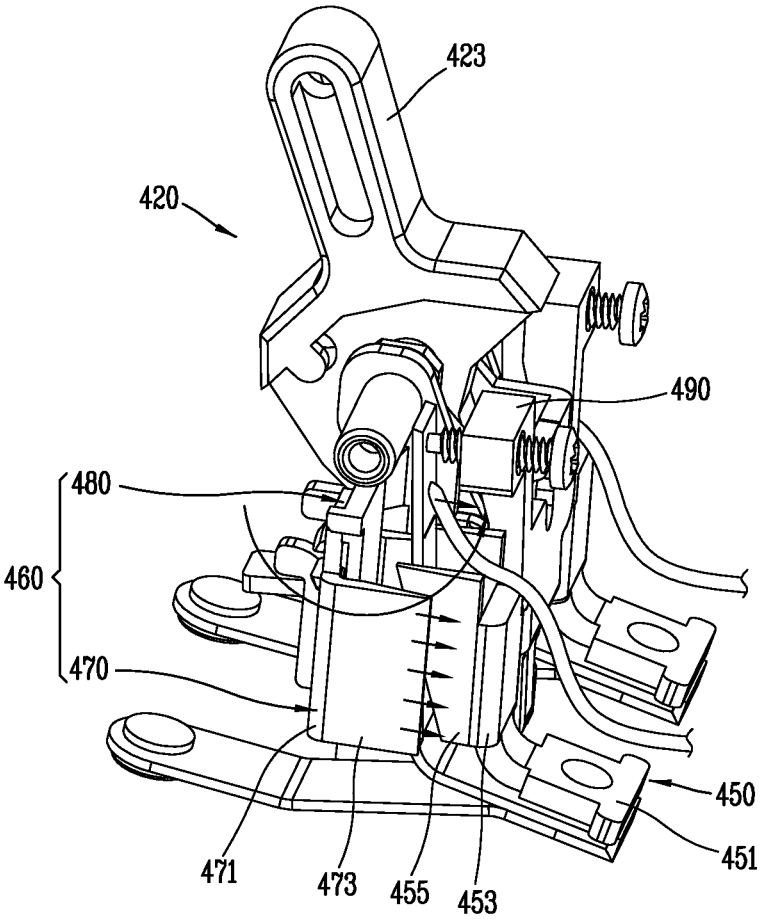
FIG. 12 is a perspective view of a major part showing an operation of the electromagnet, a first armature portion, a second armature portion and a bimetal in the circuit breaker according to the first embodiment of the present invention.

The electromagnet 450 may then be magnetized by the fault current to apply a magnetic attractive force to the armature assembly 460 as shown in FIG. 12. At this time, since the fixing portion 451 is fixed, the electromagnet 450 does not move.

At this time, a magnetic attractive force may act on the base portion 471 and the wing portion 473 of the second armature portion 470.

Accordingly, the armature assembly 460 may move toward the electromagnet 450 by the magnetic attractive force of the electromagnet 450.

The armature assembly 460 pushes the trip bar 490, while being moved by the magnetic attractive force of the electromagnet 450.

That is, as the magnetism attractive force of the electromagnet 450 acts on the second armature portion 470, the second armature portion 470 is coupled to the first armature portion 480 and moves toward the electromagnet 450 together.

Therefore, the cam surface portion 487 of the first armature portion 480 may continue to move in contact with the trip bar 490. Thus, the trip bar 490, which is pivotally supported by a pivot shaft (not shown) in a lower end rotates in a clockwise direction in FIG. 12.

As the trip bar 490 rotates in the clockwise direction, one end of the lever 424, which has been restrained by the support groove portion of the trip bar 490, is released.

Then, the cross bar 425 rises as the compression spring (not shown) discharges elastic energy, the movable contact arm 417 supported by the cross bar 425 rises to be separated from the corresponding stationary contact arm 415 so that the circuit is automatically broken (tripped).

The instant trip operation can be performed before the thermal trip operation by the bimetal 440 is performed.

Further, since the magnetic force of the electromagnet 450 is extinguished, the armature assembly 460 may be rotated in a clockwise direction by its own weight to return to the original position. At this time, the cam surface portion 487 also moves so as to be separated from the trip bar 490, so that the trip bar 490 is also returned to the original position by a return spring (not shown) which applies an elastic force to return to the original position at a lower portion of the trip bar 490.

Therefore, if a cause of the fault current is removed, the user may immediately manually operate the handle 423 to an OFF position to reset the circuit breaker and manually operate the handle 423 to an ON position to close the circuit.

According to the present invention, the circuit breaker 400 may generate a magnetic force by using a current applied to the trip mechanism 430, and may shut off the circuit based thereon. Therefore, when the circuit is broken, the magnetic force in the trip mechanism 430 can be extinguished. As a result, the circuit breaker 400 can be brought into a state that the circuit is reclosed. That is, after the circuit breaker 400 according to the present invention breaks the circuit, the circuit breaker 400 may close the circuit again without time delay. This allows the circuit breaker 400 to operate more efficiently.

A circuit breaker according to a second preferred embodiment of the present invention will be described with reference to FIGS. 13 to 18D.

Figure 13:
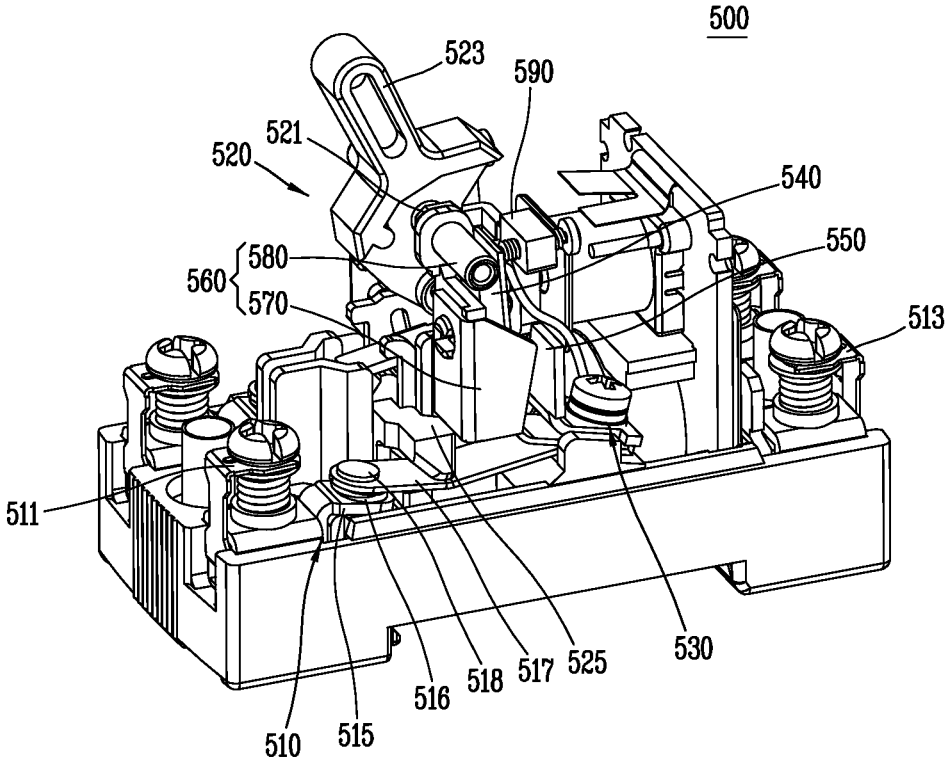
FIG. 13 is a perspective view showing a configuration of a circuit breaker according to a second embodiment of the present invention, in a state that an upper cover is removed.
Figure 14:
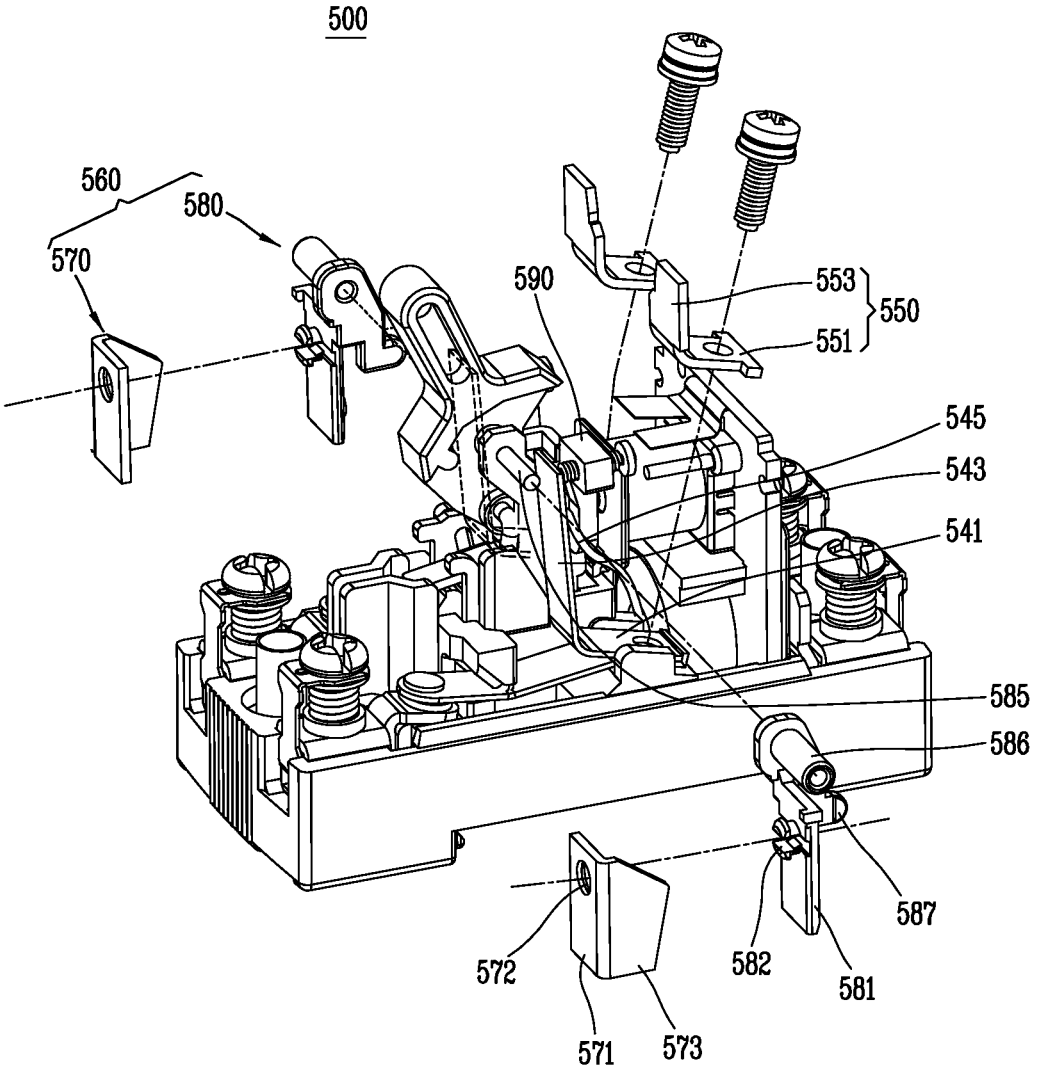
FIG. 14 is a partially exploded perspective view of an instant trip mechanism showing a configuration of the instant trip mechanism in the circuit breaker according to the second embodiment of the present invention.

Referring to FIG. 13 or 14, the circuit breaker 500 according to the second embodiment may comprise a contact mechanism 510, a switching mechanism 520, a trip bar 590, and a trip mechanism 530.

The contact mechanism 510 may comprise a terminal part connected to an electric power source side and an electric load side and a switching contact part for opening and closing the circuit. That is, the contact mechanism 510 comprises a first terminal 511, a second terminal 513, a stationary contact arm 515, and a movable contact arm 517.

The first terminal 511 and the second terminal 513 may be connected to either the electric power source side or the electric load side of the circuit in the contact mechanism 510. The first terminal 511 may be connected to the electric power source side, and the second terminal 513 may be connected to the electric load side. For example, the first terminal 511 and the second terminal 513 may be disposed at both ends of the contact mechanism 510, respectively.

The stationary contact arm 515 may be provided for a pair for a 2-poles circuits.

Each stationary contact arm 515 may be fixed at a predetermined position in the contact mechanism 510. At this time, each stationary contact arm 515 may be electrically connected to the first terminal 511. Here, each stationary contact 515 may extend from the first terminal 511 so as to be integrally formed with each other. Each stationary contact 515 may comprise a stationary contact 516 disposed at an opposite end remote from the first terminal 511.

The movable contact arms 517 may also be provided as a pair for a 2-poles circuits.

Each movable contact arm 517 can move to a circuit closing position in which the movable contact arm 517 contacts the corresponding stationary contact arm 515 in the contact mechanism 510 or to a circuit opening position in which the movable contact arm 517 is separated from the corresponding stationary contact arm 515. For example, each of the movable contact arms 517 may move up and down from the upper portion of the corresponding stationary contact arm 515. At this time, each movable contact arm 517 may be electrically connected to the second terminal 513. Each movable contact arm 517 may comprise a movable contact 518 disposed on the opposite side to the side near the second terminal 513. Here, each of the movable contacts 518 is positioned to face the corresponding stationary contact 516. For example, the movable contact 518 may be disposed at an upper portion facing the stationary contact 516. In addition, each of the movable contacts 518 in the circuit closing position contacts the corresponding stationary contact 516, and each of the movable contacts 518 is separated from the corresponding stationary contact 516 in the circuit opening position.

Each of the movable contact arms 517 moves (descends) toward the corresponding stationary contact arm 515 so that each of the movable contacts 518 can contact the corresponding stationary contacts 516. Thus, the circuit between the first terminal 511 and the second terminal 513 can be connected (closed).

On the other hand, each of the movable contact arms 517 may move away from the corresponding stationary contact arm 515, so that each of the movable contacts 518 can be separated from the corresponding stationary contacts 516. Accordingly, the circuit between the first terminal 511 and the second terminal 513 can be broken (open).

The switching mechanism 520 is a mechanism for manually or automatically driving the contact mechanism 510 to a circuit opening position or a circuit closing position. That is, the switching mechanism 520 may manually transmit an operation force of a user to move the movable contact arm 517 toward the stationary contact arm 515 or to move the movable contact arm 517 to be separated from the stationary contact arm 515.

The switching mechanism 520 can also perform an operation (trip operation) to drive the movable contact arm 517 so as to automatically break the circuit in accordance with a trigger operation of the trip mechanism 530 in response to the occurrence of a fault current on the circuit.

This switching mechanism 520 may comprise a side plate 521, a handle 523, a U-shaped connecting pin 522 (best seen in FIG. 18D), a lever 524, a cross bar 525, and a compression spring (not shown).

The side plate 521 may be configured as a pair of iron plates for supporting the components constituting the switching mechanism 520 and the components constituting the switching mechanism 520 may be installed between both side plates 521.

The side plate 521 has a portion that extends upward to support the handle 523 and a lower portion that supports the remaining components that constitute the switching mechanism 520.

The handle 523 provides the user with a means for a manual opening/closing operation in the switching mechanism 520. Here, a central shaft of the handle 523 may be supported by the side plate 521. Thus, the handle 523 may be rotated within a predetermined range by a user's operation.

The U-shaped connecting pin 522 is a part that is connected to a lower portion of the handle 523 at its upper end and connected to the lever 524 at its lower end to connect the handle 523 and the lever 524 for driving.

The lever 524 is connected to a lower end of the U-shaped connecting pin 522 at a substantially middle portion in a longitudinal direction and has one end which is latched or released by a trip bar 590 described later.

The cross bar 525 is provided so as to cross a pair of movable contact arms 517 for switching a 2-poles circuits and has a lying U-shaped support portion for supporting the movable contact arm 517 by interposing with both ends thereof.

A compression spring (not shown) is installed between the cross bar 525 and a bottom surface of the enclosure of the circuit breaker 500 and elastically bias the movable contact arm 517 to move to a circuit opening position in which the movable contact arm 517 is separated from the corresponding stationary contact arm 515 through the cross bar 525.

When the circuit breaker 500 trips, the compression spring is a driving source for moving the movable contact arm 517 via the cross bar 525.

The trip bar 590 is a component having an alphabet "Y" shape and has an upper branch portion divided into two fork portions and a lower end supported by a support shaft (not shown). Here, the trip bar 590 may be subjected to an elastic force so as to return to the initial position (original position) of the trip bar 590 by a return spring (not shown).

Both ends of the branch portion are provided with adjusting screws for adjusting a gap from the bimetal 540 described later.

The trip bar 590 has a support groove portion for latching or releasing one end of the lever 524 between both forks of the upper branch portion.

Thus, the trip bar 590 is rotatable to a first position for restricting one end of the lever 524 and a second position for releasing one end of the lever 524.

When a fault current occurs in the circuit, the trip mechanism 530 may trigger the switching mechanism 520 to trip in response thereto. That is, the trip mechanism 530 drives the trip bar 590 to rotate to the second position in response to the fault current on the circuit.

The trip mechanism 530 may comprise a thermal trip mechanism and an instant trip mechanism.

Here, the thermal trip mechanism comprises a bimetal 540.

As illustrated, the bimetal 540 is connected to the circuit together with the movable contact arm 517 and the electromagnet 550 and is bent by heat based on a fault current on the circuit.

The bimetal 540 is also a means for providing a movement path of a current in the circuit and comprises an input portion 541 and an output portion 543 as shown in FIG. 5.

The bimetal 540 is configured as a bimetal strip having a substantially L shape in an alphabet and has the input portion 541 as a lower horizontal portion the output portion 543 as a vertical portion extending upward from the horizontal portion.

In the bimetal 540, the input portion 541 is a portion through which a current flows in, and the output portion 543 is a portion through which a current flows out and also provides a mechanical output that is bent in response to a fault current on the circuit.

Figure 16:
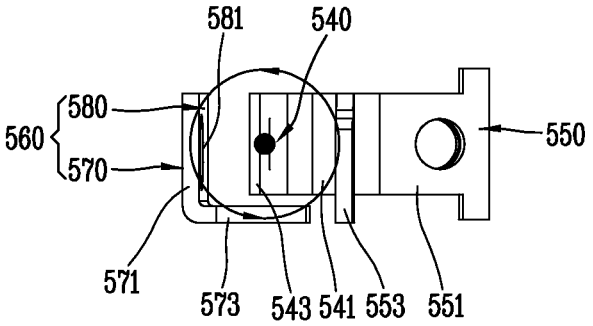
FIG. 16 is a plan view of a bimetal, an electromagnet, and a second armature portion showing formation of a magnetic path loop by an electromagnet and a second armature portion in the vicinity of a bimetal in the circuit breaker according to the second embodiment of the present invention.

Since the output portion 543 of the bimetal 540 is also a current path, a magnetic field is generated around the output portion 543 (see FIG. 16).

In FIG. 14, reference numeral 545 designates a conductive wire which provides a current path so that a current flowing from the bimetal 540 flows toward the second terminal 513 side.

The instant trip mechanism comprises a pair of electromagnets 550 and a pair of armature assemblies 560 corresponding to the 2-poles circuits.

The pair of electromagnets 550 are provided to face the pair of armature assemblies 560 and apply a magnetic attractive force to the pair of armature assemblies 560 in response to the fault current on the circuit for which an instant trip is required.

Figure 17:
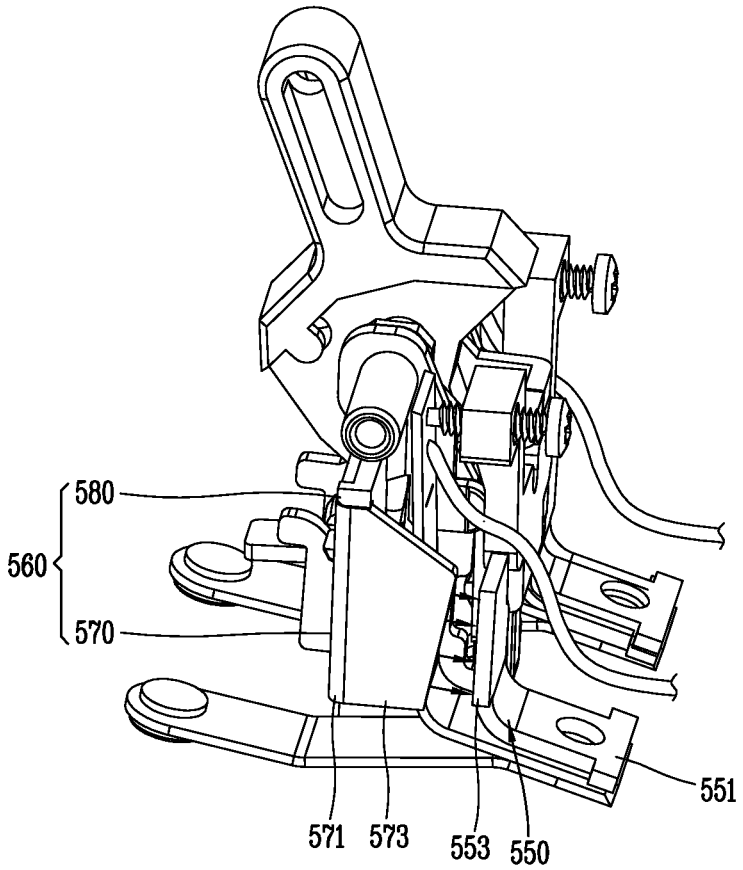
FIG. 17 is a perspective view of a major part showing a state that the second armature portion is attracted by the electromagnet in the circuit breaker according to the second embodiment of the present invention.

As illustrated in FIG. 17, each of the pair of electromagnets 550 may be configured as an L-shaped conductive metal plate having a vertical plate portion and a horizontal plate portion, and comprises a fixing portion 551 and a first electromagnet portion 553.

The fixing portion 551 may be a portion for fixing the electromagnet 550 and may be fixed to the bottom surface of the enclosure of the circuit breaker 500 by a fixing screw. At this time, the fixing portion 551 may be fixed together with the input portion 541 of the bimetal 540 and the end of the movable contact arm 517. Specifically, the fixing portion 551 may be fixed to the bottom surface of the enclosure of the circuit breaker 500 in a state that the fixing portion 551 is stacked on the input portion 541 of the bimetal 540 and the movable contact arm 517.

The first electromagnet portion 553 and the second electromagnet portion 555 may be magnetized by a current on the circuit. Therefore, the first electromagnet portion 553 and the second electromagnet portion 555 may generate a magnetic attractive force toward the armature assembly 560.

The first electromagnet portion 553 may be connected to the fixing portion 551. The first electromagnet portion 553 may extend from the fixing portion 551. Here, the first electromagnet portion 553 may be bent from the fixing portion 551.

The pair of armature assemblies 560 are provided to correspond to the two poles of the circuits and are movable to a position at in which pressure is applied to the trip bar 590 to rotate to the second position.

The armature assembly 560 may be moved by a magnetic force of the electromagnet 550. Here, the armature assembly 560 may be rotated by a magnetic force of the electromagnet 550. To this end, the armature assembly 560 may be rotatably supported by the switching mechanism 520. Here, the magnetic force is a magnetic attractive force. The armature assembly 560 may approach the electromagnet 550 by the magnetic attractive force of the electromagnet 550. Through this, the armature assembly 560 may apply pressure to the trip bar 590.

Referring to FIG. 14, the pair of armature assemblies 560 may comprise a first armature portion 580, a second armature portion 570, and a coupling portion 581, respectively.

The first armature portion 580 is pivotally supported and rotatable. That is, the first armature portion 580 is rotatably supported by a rotary shaft 585 provided so as to pass through the side plate 521 and the handle 523 of the switching mechanism 520.

As illustrated in FIG. 14, the first armature portion 580 comprises a coupling portion 581, a coupling protrusion 582, a shaft receiving tubular portion 586, and a cam surface portion 587.

A function of the first armature portion 580 is to rotate the second armature portion 570 and push the trip bar 590.

Accordingly, the first armature portion 580 can be formed by molding a synthetic resin material, not a steel material, according to a preferred embodiment.

The coupling portion 581 is a means for coupling the first armature portion 580 and the second armature portion 570, and may be a piece made of a plate-like synthetic resin material.

The coupling protrusion 582 may be integrally formed with the coupling portion 581 and extend from a plate surface of the coupling portion 581.

The coupling protrusion 582 is inserted into a coupling hole portion 572 formed corresponding to the second armature portion 570 and has two divided elastic configurations that may be spread and puckered according to a preferred embodiment.

The coupling protrusion 582 may be puckered when inserted into the coupling hole portion 572 of the second armature portion 570 and may be spread when inserting is completed, firmly maintaining a coupling state of the first armature portion 580 and the second armature portion 570.

The shaft receiving tubular portion 586 is formed to extend to an upper portion of the coupling portion 581 and is formed as a hollow tube portion which is hollow inside so as to receive the rotary shaft 585.

Referring to FIG. 14, since the rotation direction of the first armature portion 580 and the extending direction of the rotation shaft 585 are perpendicular to each other, the shaft receiving tubular portion 586 extends to correspond to the rotary shaft 585 from a central portion of the plane extending from an upper portion of the coupling portion 581 at a right angle to a flat surface of the coupling portion 581.

The cam surface portion 587 is a portion that presses the trip bar 590 in the first armature portion 580 and is configured as a curved portion protruding from the flat surface of the coupling portion 581 toward the trip bar 590 according to a preferred embodiment.

A portion of the trip bar 590 to which the cam surface portion 587 contacts is a corresponding one of the two branch portions as illustrated in FIG. 18B. The second armature portion 570 is coupled with the first armature portion 580 so as to be rotatable together and is disposed to face the corresponding electromagnet 550.

The second armature portion 570 may be disposed on the opposite side of the electromagnet 550 with respect to the bimetal 540. The second armature portion 570 can be moved toward the electromagnet 550 by a magnetic attractive force of the electromagnet 550.

The second armature portion 570 may be preferably formed of iron so as to be attracted by the magnetic attractive force from the electromagnet 550.

As illustrated in FIG. 16, the second armature portion 570 is installed to surround the bimetal 540 together with the facing electromagnet 550 so as to form a closed loop of a magnetic path together with the corresponding electromagnet 550.

As illustrated in FIG. 14, each of the second armature portions 570 comprises a base portion 571 and at least one wing portion 573.

According to the embodiment shown in FIG. 14, the wing portion 573 is configured as a single wing portion extending from one side of the base portion 571.

Figure 15:
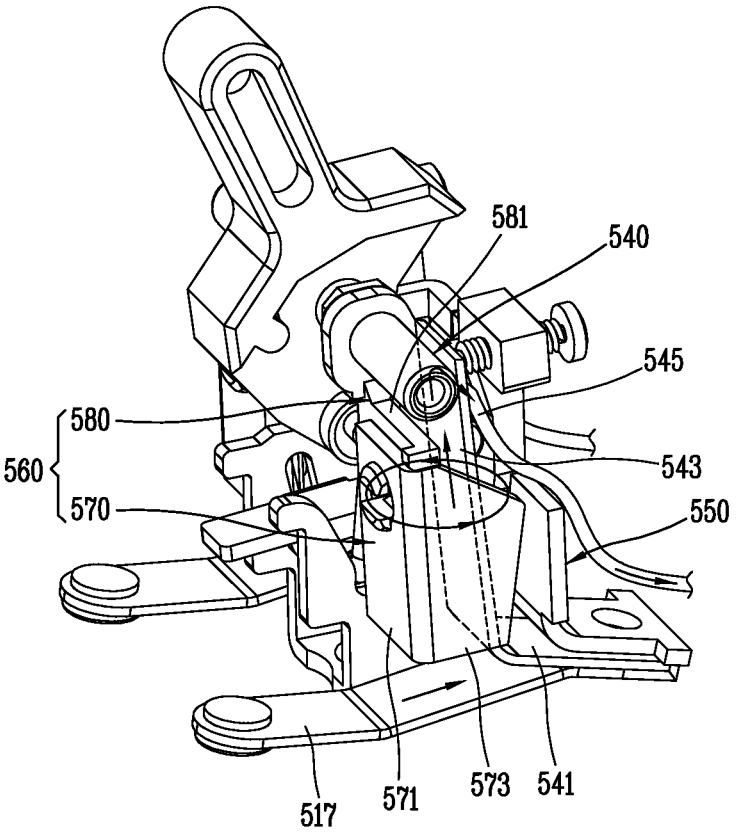
FIG. 15 is a perspective view of a major part showing a flow of current in a circuit breaker according to the second embodiment of the present invention.

As illustrated in FIGS. 13 to 15, the base portion 571 is disposed so as to face the corresponding electromagnet 550.

As illustrated in FIG. 14, the base portion 571 has a coupling hole portion 572 for allowing the coupling protrusion 582 of the first armature portion 580 to be inserted thereinto.

The base portion 571 may be disposed parallel to the first electromagnet portion 553 of the electromagnet 550. At this time, the base portion 571 may be disposed on the opposite side of the first electromagnet portion 553 with respect to the output portion 543 of the bimetal 540 as shown in FIG. 16.

The wing portion 573 extends from the base portion 571 toward the corresponding electromagnet 550.

The wing portion 573 may be formed by bending the base portion 571.

The intensity of a magnetic force between the second armature portion 570 and the electromagnet 550 can be determined according to an area where the second armature portion 570 and the electromagnet 550 face each other. That is, as the area where the second armature portion 570 and the electromagnet 550 face each other is increased, an operation effect of the magnetic attractive force of the electromagnet 550 acting on the second armature portion 570 may be increased.

The operation of the circuit breaker 500 according to the second embodiment of the present invention will now be described with reference to FIGS. 18A to 18D.

First, when a fault current such as an over current or an electric shortage current is generated in a circuit to which the circuit breaker 500 is connected, as indicated by the arrow in FIG. 15, the fault current may flow by way of the input portion 541 of the bimetal 540 from the movable contact arm 517 and then through the output portion 543 of the bimetal 540 and then to the conductive wire 545. Therefore, a magnetic field may be generated around a current path at the output portion 543 of the bimetal 540. A magnetic path may be formed in the form of a closed loop through the electromagnet 550 and the armature assembly 560 disposed around the bimetal 540 may be formed as shown in FIG. 16.

The electromagnet 550 may then be magnetized by the fault current to apply a magnetic attractive force to the armature assembly 560 as shown in FIG. 17. At this time, since the fixing portion 551 is fixed, the electromagnet 550 does not move.

At this time, a magnetic attractive force may act on the base portion 571 and the wing portion 573 of the second armature portion 570.

Accordingly, the armature assembly 560 may move toward the electromagnet 550 by the magnetic attractive force of the electromagnet 550.

The armature assembly 560 pushes the trip bar 590, while being moved by the magnetic attractive force of the electromagnet 550.

That is, as the magnetism attractive force of the electromagnet 550 acts on the second armature portion 570, the second armature portion 570 is coupled to the first armature portion 580 and moves toward the electromagnet 550 together.

Therefore, the cam surface portion 587 of the first armature portion 580 may continue to move in contact with the trip bar 590. Thus, the trip bar 590, which is pivotally supported by a pivot shaft (not shown) in a lower end rotates in a clockwise direction in FIGS. 18A to 18D.

As the trip bar 590 rotates in the clockwise direction, one end of the lever 524, which has been restrained by the support groove portion of the trip bar 590, is released.

Then, the cross bar 525 rises as the compression spring (not shown) discharges elastic energy, the movable contact arm 517 supported by the cross bar 525 rises to be separated from the corresponding stationary contact arm 515 so that the circuit is automatically broken (tripped).

The instant trip operation can be performed before the thermal trip operation by the bimetal 540 is performed.

Further, since the magnetic force of the electromagnet 550 is extinguished, the armature assembly 560 may be rotated in a clockwise direction by its own weight to return to the original position. At this time, the cam surface portion 587 also moves so as to be separated from the trip bar 590, so that the trip bar 590 is also returned to the original position by a return spring (not shown) which applies an elastic force to return to the original position at a lower portion of the trip bar 590.

Therefore, if a cause of the fault current is removed, the user can immediately manually operate the handle 523 to an OFF position to reset the circuit breaker 500 and manually operate the handle 523 to an ON position to close the circuit.

According to the present invention, the circuit breaker 500 may generate a magnetic force by using a current applied to the trip mechanism 530, and may break the circuit based thereon. Therefore, when the circuit is broken, the magnetic force in the trip mechanism 530 can be extinguished. As a result, the circuit breaker 500 may be brought into a state that the circuit is closed again. That is, after the switching mechanism 520 breaks the circuit, the circuit breaker 500 according to the present invention can reclose the circuit without time delay. This allows the circuit breaker 500 to operate more efficiently.

A circuit breaker according to a third embodiment of the present invention will now be described with reference to FIGS. 19 to 21.

A circuit breaker 600 according to the third embodiment of the present invention comprises a contact mechanism 610, a switching mechanism 620, a trip bar 690, and a trip mechanism 630.

The trip mechanism 630 comprises a bimetal 640 as a thermal trip mechanism and comprises a pair of armature assemblies 660 and a pair of electromagnets 650 corresponding to two poles of circuits as an instant trip mechanism.

Here, since the components of the circuit breaker 600 according to the third embodiment of the present invention are similar to those of the circuit breaker 500 according to the second embodiment of the present invention described above, only different components will be described and description of the same or similar components will be omitted in order to avoid repetition.

However, in the circuit breaker 600 according to the third embodiment of the present invention, a pair of armature assemblies 660 may be different from the pair of armature assemblies 560 of the circuit breaker 500 according to the second embodiment described above. At this time, the armature assembly 660 according to the third embodiment and the armature assembly 560 according to the second embodiment may be different in terms of shape or configuration. Here, the armature assembly 660 according to the third embodiment may have an enlarged area facing the electromagnet 650.

Each of the pair of electromagnets 650 is provided with a cutout groove portion 653*a* provided at the top edge of the electromagnet 650 so as to guide a conductive wire.

The armature assembly 660 can be moved by a magnetic attractive force of the electromagnet 650. Here, the armature assembly 660 can be rotationally moved by the magnetic attractive force of the electromagnet 650. To this end, the armature assembly 660 may be rotatably supported by the switching mechanism 620. The armature assembly 660 is accessible to the electromagnet 650 by the magnetic attractive force of the electromagnet 650.

This moving amateur assembly 660 may apply pressure to the trip bar 690, while being moved.

The electromagnet 650 may comprise a fixing portion 651 and an electromagnet portion 653. In addition, the armature assembly 660 may comprise a second armature portion 670 and a first armature portion 680.

The second armature portion 670 is preferably made of steel and may be attracted and moved by the magnetic attractive force of the electromagnet 650. The second armature portion 670 may comprise a base portion 671 and a plurality of wing portions 673. For example, the second armature portion 670 may be formed in a C shape when viewed from the top or bottom.

The wing portions 673 may be connected to the base portion 671. At this time, the wing portions 673 may be connected to the edge region of the base portion 671. Here, the wing portions 673 may be connected to both side portions of the base portion 671, respectively. The wing portions 673 may extend from the base portion 671 in a direction facing the electromagnet portion 653 of the electromagnet 650. Here, the wing portions 673 may be formed to be bent from the base 671. For example, the wing portions 673 may extend to the outside of the electromagnet portion 653 and may extend to the inside of the electromagnet portion 653. The wing portions 673 may also pass through the outside of the bimetal 640.

The first armature portion 680 can apply pressure to the trip bar 690. At this time, the first armature portion 680 may be disposed between the second armature portion 670 and the electromagnet 650. Also, the first armature portion 680 may move together with the second armature portion 670. The first armature portion 680 may comprise a coupling portion 681, a coupling protrusion 682, a shaft receiving tubular portion 686 and a cam surface portion 687.

The coupling portion 681 is a means for coupling the first armature portion 680 and the second armature portion 670, and may be a piece made of a plate-like synthetic resin material.

The coupling protrusion 682 may be integrally formed with the coupling portion 681 and extend from a plate surface of the coupling portion 681.

The coupling protrusion 682 is inserted into a coupling hole portion 672 formed corresponding to the second armature portion 670 and has two divided elastic configurations that can be spread or puckered according to a preferred embodiment.

The coupling protrusion 682 can be puckered when inserted into the coupling hole portion 672 of the second armature portion 670 and may be spread when inserting is completed, firmly maintaining a coupling state of the first armature portion 680 and the second armature portion 670.

The shaft receiving tubular portion 686 is formed to extend to an upper portion of the coupling portion 681 and is formed as a hollow tube portion which is hollow inside so as to receive the rotary shaft 685.

Referring to FIG. 19, since the rotation direction of the first armature portion 680 and the extending direction of the rotation shaft 685 are perpendicular to each other, the shaft receiving tubular portion 686 extends to correspond to the rotary shaft 685 from a central portion of the plane extending from an upper portion of the coupling portion 681 at a right angle to a flat surface of the coupling portion 681.

The cam surface portion 687 is a portion that presses the trip bar 690 in the first armature portion 680 and is configured as a curved portion protruding from the flat surface of the coupling portion 681 toward the trip bar 690 according to a preferred embodiment.

The portion of the trip bar 690 to which the cam surface portion 687 contacts is one of the two upper branch portions.

An operation of the circuit breaker 600 according to the third embodiment will be described with reference to FIGS. 20 and 21.

First, when a fault current such as an over current or an electric shortage current is generated in a circuit to which the circuit breaker 600 is connected, as indicated by the arrow in FIG. 20, the fault current may flow by way of the bimetal 640 from the movable contact arm to the conductive wire (not given a reference numeral). Therefore, a magnetic field may be generated around a path of a current through the bimetal 640. A magnetic path may be formed in the form of a closed loop through the electromagnet 650 and the armature assembly 660 disposed around the bimetal 640 may be formed as shown in FIG. 20.

The electromagnet 650 may then be magnetized by the fault current to apply a magnetic attractive force to the armature assembly 660.

At this time, a magnetic attractive force may act on the base portion 671 and the wing portion 673 of the second armature portion 670.

Accordingly, the armature assembly 660 may move toward the electromagnet 650 by the magnetic attractive force of the electromagnet 650.

The armature assembly 660 pushes the trip bar 690, while being moved by the magnetic attractive force of the electromagnet 650.

That is, as the magnetism attractive force of the electromagnet 650 acts on the second armature portion 670, the second armature portion 670 is coupled to the first armature portion 680 and moves toward the electromagnet 650 together.

Therefore, the cam surface portion 687 of the first armature portion 680 may continue to move in contact with the trip bar 690. Thus, the trip bar 690, which is pivotally supported by a pivot shaft (not shown) in a lower end rotates in a clockwise direction in FIG. 20.

As the trip bar 690 rotates in the clockwise direction, a lever (not given a reference numeral) restrained by the support groove portion formed at an upper center of the trip bar 690 is released.

Then, the cross bar 625 rises as the compression spring (not shown) discharges elastic energy, the movable contact arm supported by the cross bar rises to be separated from the corresponding stationary contact arm 615 so that the circuit is automatically broken (tripped).

The instant trip operation can be performed before the thermal trip operation by the bimetal 640 is performed.

Further, since the magnetic force of the electromagnet 650 is extinguished, the armature assembly 660 may be rotated in a clockwise direction by its own weight to return to the original position. At this time, the cam surface portion 687 also moves so as to be separated from the trip bar 690, so that the trip bar 690 is also returned to the original position by a return spring (not shown) which applies an elastic force to return to the original position at a lower portion of the trip bar 690.

Therefore, if a cause of the fault current is removed, the user may immediately manually operate the handle to an OFF position to reset the circuit breaker 600 and manually operate the handle to an ON position to close the circuit (the circuit breaker 600 is operated to the ON position).

According to the present invention, the circuit breaker 600 may generate a magnetic force by using a current applied to the trip mechanism 630, and may break the circuit based thereon. Therefore, when the circuit is broken, the magnetic force in the trip mechanism 630 may be extinguished. As a result, the circuit breaker 600 may be brought into a state that the circuit can be reclosed. That is, after the trip mechanism 630 breaks the circuit, the circuit breaker 600 according to the present invention can be reclosed without time delay. This allows the circuit breaker 600 to operate more efficiently.

Meanwhile, a circuit breaker according to a fourth embodiment of the present invention will be described with reference to FIGS. 22 to 36.

Referring to FIGS. 22 and 23, the circuit breaker 700 according to the fourth embodiment of the present invention comprises a contact mechanism 710, a switching mechanism 720, a trip bar 790, and a trip mechanism 730.

The contact mechanism 710 may comprise a terminal part connected to an electric power source side and an electric load side and a switching contact part for opening or closing the circuit. That is, the contact mechanism 710 comprises a first terminal 711, a second terminal 713, a stationary contact arm 715, and a movable contact arm 717.

The first terminal 711 and the second terminal 713 may be connected to either the electric power source side or the electric load side of the circuit in the contact mechanism 710. The first terminal 711 may be connected to the electric power source side, and the second terminal 713 may be connected to the electric load side. For example, the first terminal 711 and the second terminal 713 may be disposed at both ends of the contact mechanism 710, respectively.

The stationary contact arm 715 may be provided with a pair for a 2-poles circuits.

Each stationary contact arm 715 may be fixed at a predetermined position in the contact mechanism 710. At this time, each stationary contact arm 715 may be electrically connected to the first terminal 711. Here, each stationary contact 715 may extend from the first terminal 711 so as to be integrally formed with each other. Each stationary contact 715 may comprise a stationary contact 716 disposed at an opposite end remote from the first terminal 711.

The movable contact arms 717 may also be provided with a pair for 2-poles circuits.

Each movable contact arm 717 may move to a circuit closing position in which the movable contact arm 717 contacts the corresponding stationary contact arm 715 in the contact mechanism 710 and to a circuit opening position in which the movable contact arm 717 is separated from the corresponding stationary contact arm 715. For example, each of the movable contact arms 717 may move up and down from the upper portion of the corresponding stationary contact arm 715. At this time, each movable contact arm 717 may be electrically connected to the second terminal 713. Each movable contact arm 717 may comprise a movable contact 718 disposed on the opposite side to the side near the second terminal 713. Here, each of the movable contacts 718 is positioned to face the corresponding stationary contact 716. For example, the movable contact 718 may be disposed at an upper portion facing the stationary contact 716. In addition, each of the movable contacts 718 in the circuit closing position contacts the corresponding stationary contact 716, and each of the movable contacts 718 is separated from the corresponding stationary contact 716 in the circuit opening position.

Each of the movable contact arms 717 moves (descends) toward the corresponding stationary contact arm 715 so that each of the movable contacts 718 may contact the corresponding stationary contacts 716. Thus, the circuit between the first terminal 711 and the second terminal 713 may be connected (closed).

On the other hand, each of the movable contact arms 717 may move away from the corresponding stationary contact arm 715, so that each of the movable contacts 718 may be separated from the corresponding stationary contacts 716. Accordingly, the circuit between the first terminal 711 and the second terminal 713 may be broken (open).

The switching mechanism 720 is a mechanism for manually or automatically driving the contact mechanism 710 to a circuit opening position or a circuit closing position. That is, the switching mechanism 720 may transmit an operation force of a user to move the movable contact arm 717 toward the stationary contact arm 715 or to move the movable contact arm 717 to be separated from the stationary contact arm 715.

The switching mechanism 720 may also perform an operation (trip operation) to drive the movable contact arm 717 so as to automatically break the circuit in accordance with a trigger operation of the trip mechanism 730 in response to the occurrence of a fault current on the circuit.

This switching mechanism 720 may comprise a side plate 721, a handle 723, a U-shaped connecting pin 722 (See FIG. 23), a lever 724, a cross bar 725, and a compression spring (not shown).

The side plate 721 may be configured as a pair of iron plates for supporting the components constituting the switching mechanism 720 and the components constituting the switching mechanism 720 may be installed between both side plates 721.

The side plate 721 has a portion that extends upward to support the handle 723 and a lower portion that supports the remaining components that constitute the switching mechanism 720.

The handle 723 provides the user with a means for a manual opening/closing operation in the switching mechanism 720. Here, a central shaft of the handle 723 may be supported by the side plate 721. Thus, the handle 723 may be rotated within a predetermined range by a user's operation.

The U-shaped connecting pin 722 is a part that is connected to a lower portion of the handle 723 at its upper end and connected to the lever 724 at its lower end to drive and connect the handle 723 and the lever 724.

The lever 724 is connected to a lower end of the U-shaped connecting pin 722 at a substantially middle portion in a longitudinal direction and has one end which is restrained or released by a trip bar 790 described later.

The cross bar 725 is provided so as to cross a pair of movable contact arms 717 for opening or closing a 2-poles circuits and has a lying U-shaped support portion for supporting the movable contact arm 717 by interposing with both ends thereof.

A compression spring (not shown) is installed between the cross bar 725 and a bottom surface of the enclosure of the circuit breaker 700 and elastically bias the movable contact arm 717 to move to a circuit opening position in which the movable contact arm 717 is separated from the corresponding stationary contact arm 715 through the cross bar 725.

When the circuit breaker 700 trips, the compression spring becomes a driving source for moving the movable contact arm 717 via the cross bar 725.

The trip bar 790 is a component having an alphabet "Y" shape and has an upper branch portion divided into two fork portions and a lower end supported by a support shaft (not shown).

Both ends of the branch portion are provided with adjusting screws for adjusting a gap from the bimetal 740 described later.

The trip bar 790 has a support groove portion for restraining or releasing one end of the lever 724 between both forks of the upper branch portion.

Thus, the trip bar 790 is rotatable to a first position for restricting one end of the lever 724 and a second position for releasing one end of the lever 724.

When a fault current occurs in the circuit, the trip mechanism 730 may trigger the trip mechanism 720 to trip in response thereto. That is, the trip mechanism 730 drives the trip bar 790 to rotate to the second position in response to the fault current on the circuit.

The trip mechanism 730 may comprise a thermal trip mechanism and an instant trip mechanism.

Here, the thermal trip mechanism comprises a bimetal 740.

As illustrated, the bimetal 740 is connected to the circuit together with the movable contact arm 717 and the electromagnet 750 and is bent by heat based on a fault current on the circuit.

The bimetal 740 is also a means for providing a flowing path of a current in the circuit and comprises an input portion 741 and an output portion 743 as shown in FIG. 34.

The bimetal 740 is configured as a bimetal strip having a substantially L shape in an alphabet and has the input portion 741 as a lower horizontal portion the output portion 743 as a vertical portion extending upward from the horizontal portion.

In the bimetal 740, the input portion 741 is a portion through which a current flows in, and the output portion 743 is a portion through which a current flows out and also provides a mechanical output that is bent in response to a fault current on the circuit.

Since the output portion 743 of the bimetal 740 is also a current path, a magnetic field is generated around the output portion 743 (see FIG. 34).

The instant trip mechanism comprises a pair of electromagnets 750 and a pair of armature assemblies 760 corresponding to the 2-poles circuits.

The pair of electromagnets 750 comprises a first base plane portion 753 facing the second armature portion 770 and a first wing portion 755 extending from the first base plane portion 753 toward the second armature portion 770.

The pair of armature assemblies 760 comprises a first armature portion 780 and a second armature portion 770, respectively.

A pair of electromagnets 750 are provided to face the pair of armature assemblies 760 to apply a magnetic attractive force to the pair of armature assemblies 760 in response to the fault current on the circuit for which an instant trip is required.

As illustrated in FIG. 25, each of the pair of electromagnets 750 may comprise a fixing portion 751, a first base plane portion 753, and at least one first wing portion 755.

The fixing portion 751 may be a portion for fixing the electromagnet 750 and may be fixed to the bottom surface of the enclosure of the circuit breaker 700 by a fixing screw. At this time, the fixing portion 751 may be fixed together with the input portion 741 of the bimetal 740 and the end of the movable contact arm 717. Specifically, the fixing portion 751 may be fixed to the bottom surface of the enclosure of the circuit breaker 700 in a state that the fixing portion 751 is stacked on the input portion 741 of the bimetal 740 and the movable contact arm 717.

The first base plane portion 753 and the second electromagnet portion 755 may be magnetized by a current on the circuit. Accordingly, the first base plane portion 753 and the first wing portion 755 may generate a magnetic attractive force toward the armature assembly 760.

The first base plane portion 753 may be connected to the fixing portion 751. The first base plane portion 753 may extend from the fixing portion 751. Here, the first base plane portion 753 may be bent from the fixing portion 751.

The first wing portion 755 may be connected to the first base plane portion 753. The first wing portion 755 may be connected to an edge region of the first base plane portion 753. Here, the first wing portion 755 may be connected to at least one of the both side portions of the first base plane portion 753. The first wing portion 755 may extend from the first base plane portion 753 toward the armature assembly 760. Here, the first wing portion 755 may be formed to be bent from the first base plane portion 753. The first wing 755 may also extend to the outside of the armature assembly 760 and extend into the inside of the armature assembly 760.

A length of the first wing portion 755 may exceed a length of the first base plane portion 753.

The pair of armature assemblies 760 are provided to correspond to the two poles of the circuits and are movable to a position at in which pressure is applied to the trip bar 790 to rotate to the second position.

The armature assembly 760 may be moved by a magnetic force of the electromagnet 750. Here, the armature assembly 760 may be rotated by a magnetic force of the electromagnet 750. To this end, the armature assembly 760 may be rotatably supported by the switching mechanism 720. Here, the magnetic force is a magnetic attractive force. The armature assembly 760 may approach the electromagnet 750 by the magnetic attractive force of the electromagnet 750. Through this, the armature assembly 760 may apply pressure to the trip bar 790.

Referring to FIG. 23, the pair of armature assemblies 760 may comprise a first armature portion 780, a second armature portion 770, and a coupling portion 781, respectively.

The first armature portion 780 is pivotally supported and rotatable. That is, the first armature portion 780 is rotatably supported by a rotary shaft 785 provided so as to pass through the side plate 721 and the handle 723 of the switching mechanism 720.

As illustrated in FIG. 23, the first armature portion 780 comprises a coupling portion 781, a coupling protrusion 782, a shaft receiving tubular portion 786, and a cam surface portion 787.

A function of the first armature portion 780 is to rotate the second armature portion 770 and push the trip bar 790.

Accordingly, the first armature portion 780 may be formed by molding a synthetic resin material, not a steel material, according to a preferred embodiment.

The coupling portion 781 is a means for coupling the first armature portion 780 and the second armature portion 770, and may be a piece made of a plate-like synthetic resin material.

The coupling protrusion 782 may be integrally formed with the coupling portion 781 and extend from a plate surface of the coupling portion 781.

The coupling protrusion 782 is fitted to a coupling hole portion 772 formed corresponding to the second armature portion 770 and has two divided elastic configurations that may be spread and puckered according to a preferred embodiment.

The coupling protrusion 782 may be puckered when inserted into the coupling hole portion 772 of the second armature portion 770 and may be spread when inserting is completed, firmly maintaining a coupling state of the first armature portion 780 and the second armature portion 770.

The shaft receiving tubular portion 786 is formed to extend to an upper portion of the coupling portion 781 and is formed as a hollow tube portion which is hollow inside so as to receive the rotary shaft 785.

Referring to FIG. 23, since the rotation direction of the first armature portion 780 and the extending direction of the rotation axis 785 are perpendicular to each other, the shaft receiving tubular portion 786 extends to correspond to the rotary shaft 785 from a central portion of the plane extending from an upper portion of the coupling portion 781 at a right angle to a flat surface of the coupling portion 781.

The cam surface portion 787 is a portion that presses the trip bar 790 in the first armature portion 780 and is configured as a curved portion protruding from the flat surface of the coupling portion 781 toward the trip bar 790 according to a preferred embodiment.

A portion of the trip bar 790 to which the cam surface portion 787 contacts is a corresponding one of the two branch portions as illustrated in FIG. 22.

The second armature portion 770 is coupled with the first armature portion 780 so as to be rotatable together and is disposed to face the corresponding electromagnet 750.

The second armature portion 770 may be disposed on the opposite side of the electromagnet 750 with respect to the bimetal 740. The second armature portion 770 may be moved toward the electromagnet 750 by a magnetic attractive force of the electromagnet 750.

The second armature portion 770 may be preferably formed of iron so as to be attracted by the magnetic attractive force from the electromagnet 750.

As illustrated in FIG. 33, the second armature portion 770 is installed to surround the bimetal 740 together with the facing electromagnet 750 so as to form a closed loop of a magnetic path together with the corresponding electromagnet 750.

As illustrated in FIG. 28, each of the second armature portions 770 comprises a second base plane portion 771 and at least one second wing portion 773.

The second base plane portion 771 may be disposed to face the first base plane portion 753 of the electromagnet 750 and the second wing portion 773 may extend from the second base plane portion 771 toward the electromagnet 750 so as to be meshed with the electromagnet 750.

According to the embodiment shown in FIG. 28, the second wing portion 773 is configured with one wing portion extending from one side of the second base plane portion 771.

As illustrated in FIGS. 29 to 32, the second base plane portion 771 is disposed so as to face the corresponding electromagnet 750.

As illustrated in FIG. 28, the second base plane portion 771 has a coupling hole portion 772 for allowing the coupling protrusion 782 of the first armature portion 780 to be inserted thereinto.

The base portion 771 may be disposed parallel to the first base plane portion 753 of the electromagnet 750. At this time, the base portion 771 may be disposed on the opposite side of the first base plane portion 753 with respect to the output portion 743 of the bimetal 740 as shown in FIG. 23.

The second wing portion 773 extends from the second base plane portion 771 toward the corresponding electromagnet 750.

The second wing portion 773 extends from the second base plane portion 771 toward the corresponding electromagnet 750.

The second wing portion 773 may be formed to be bent from the second base plane portion 771.

The intensity of a magnetic attractive force of the electromagnet 750 acting on the second armature portion 770 can be determined according to an area where the second armature portion 770 and the electromagnet 750 face each other. That is, as the area where the second armature portion 770 and the electromagnet 750 face each other is increased, an operation effect of the magnetic attractive force of the electromagnet 750 acting on the second armature portion 770 may be increased.

Therefore, in addition to the magnetic attractive force applied by the first base plane portion 753 of the electromagnet 750 to the base portion 771 of the second armature portion 770 facing the electromagnet 750, in order to increase an operation effect of the magnetic attractive force of the electromagnet 750 acting on the second armature portion 770, as illustrated in FIGS. 24 and 29 to 32, the first wing portion 755 and the wing portion 773 are formed such that a surface distance of surfaces of the first wing portion 755 and the wing portion 773 facing each other is formed to be long. That is, according to a preferred aspect of the present invention, a surface distance of mutually facing surfaces of the second armature portion 770 and the electromagnet 750 is long so as to increase an area facing each other.

According to one embodiment, the first wing portion 755 and the second wing portion 773 may be configured such that mutually facing planes are parallel to each other.

In order to increase a magnetic attraction effect by increasing the mutually facing area, as shown in FIG. 24, according to a first embodiment, mutually facing surfaces of the wing portion 773 of the second armature portion 770 and the electromagnet 750 have a plurality of concave portions 757 and convex portions 775 and the plurality of concave portions 757 and the convex portions 775 are formed to have a shape of a plurality of teeth.

In order to increase a magnetic attraction effect by increasing the mutually facing area, as shown in FIG. 29, according to a second embodiment, mutually facing surfaces of the wing portion 773 of the second armature portion 770 and the electromagnet 750 have a plurality of concave portions 757 and convex portions 775 and the plurality of concave portions 757 and the convex portions 775 are formed as mutually engaged meander surfaces.

In order to increase a magnetic attraction effect by increasing the mutually facing area, as shown in FIG. 30, according to a third embodiment, mutually facing surfaces of the wing portion 773 of the second armature portion 770 and the electromagnet 750 have a plurality of concave portions 757 and convex portions 775 and the plurality of concave portions 757 and the convex portions 775 are formed as a plurality of engaged step surfaces.

In order to increase a magnetic attraction effect by increasing the mutually facing area, as shown in FIG. 31, according to a fourth embodiment, mutually facing surfaces of the wing portion 773 of the second armature portion 770 and the electromagnet 750 have a plurality of concave portions 757 and convex portions 775 and mutually facing surfaces of the plurality of concave portions 757 and the convex portions 775 have a semicircular shape.

In order to increase a magnetic attraction effect by increasing the mutually facing area, as shown in FIG. 32, according to a fifth embodiment, mutually facing surfaces of the wing portion 773 of the second armature portion 770 and the electromagnet 750 have a plurality of concave portions 757 and convex portions 775 and mutually facing surfaces of the plurality of concave portions 757 and the convex portions 775 have a polygonal shape.

Therefore, compared with that the mutually facing surfaces of the first wing portion 755 and the second wing portion 773 are formed with flat surfaces, the mutually facing areas of the first wing portion 755 and the second wing portion 773 are increased, and accordingly, an operation effect (attractive force) of the magnetic attractive force of the electromagnet 750 acting on the second armature portion 770 may be increased.

The second armature portion 770 may move and engage with the electromagnet 750.

The operation of the circuit breaker 700 configured as described above will be described mainly with reference to FIGS. 35 and 36.

First, when a fault current such as an overcurrent or an electric shortage current is generated in the circuit to which the circuit breaker 700 is connected, the fault current may flow to a conductive wire (not shown) by way of the bimetal from the movable contact arm as shown in FIG. 35.

Subsequently, the electromagnet 750 is magnetized by the fault current to apply a magnetic attractive force to the armature assembly 760 as shown in FIG. 35. At this time, since the fixing portion 751 is fixed, the electromagnet 750 does not move.

At this time, a magnetic attractive force may act on the second base plane portion 771 and the second wing portion 773 of the second armature portion 770.

Thus, the armature assembly 760 may move closer to the electromagnet 750 by the magnetic attractive force of the electromagnet 750.

As the armature assembly 760 moves by the magnetic attractive force of the electromagnet 750, the armature assembly 760 pushes the trip bar 790.

That is, as the magnetic attractive force of the electromagnet 750 acts on the second armature portion 770, the second armature portion 770 is coupled to the first armature portion 780 and moves together toward the electromagnet 750.

Therefore, the cam surface portion 787 of the first armature portion 780 may continue to move in contact with the trip bar 790. The trip bar 790, whose lower end (not shown) is pivotally supported by a pivot shaft, rotates in a clockwise direction in FIG. 35.

As the trip bar 790 rotates in the clockwise direction, one end of the lever 724, which has been restrained by the support groove portion of the trip bar 790, is released.

Then, as the compression spring (not shown) discharges the elastic energy, the cross bar 725 rises, and accordingly, the movable contact arm 717 supported by the cross bar 725 rises to be separated from the corresponding fixed contact arm 715 so that the circuit is automatically broken (tripped).

This instant trip operation can be performed before the thermal trip operation by the bimetal 740 is performed.

Further, since the magnetic force of the electromagnet 750 is extinguished, the armature assembly 760 may be rotated in a clockwise direction by its own weight to return to the original position. At this time, the cam surface portion 787 also moves away from the trip bar 790, so that the trip bar 790 is also returned to its original position by the return spring (not shown) which applies an elastic force to return to the original position at a lower portion of the trip bar 790.

Therefore, if a cause of the fault current is removed, the user manually operates the handle 723 to the OFF position to reset the circuit breaker and immediately close the circuit by manually operating the handle 723 to the ON position again.

It is immediately possible for the user to manually close the handle 723 to the off position to reset the circuit breaker and manually operate the on-position again to close the circuit.

According to the present invention, the circuit breaker 700 generates a magnetic force using a current applied to the trip mechanism 730, and may break the circuit based thereon. As a result, when the circuit is broken, the magnetic force in the trip mechanism 730 may be extinguished. Accordingly, the circuit breaker 700 may be brought into a state that it can close the circuit again. That is, after the trip mechanism 730 breaks the circuit, the circuit breaker 700 according to the present invention can reclose the circuit without time delay. Accordingly, the circuit breaker 700 may be utilized more efficiently.

The foregoing embodiments and advantages are merely exemplary and are not to be considered as limiting the present disclosure. The present teachings may be readily applied to other types of apparatuses. This description is intended to be illustrative, and not to limit the scope of the claims. Many alternatives, modifications, and variations will be apparent to those skilled in the art. The features, configurations, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. A circuit breaker comprising:

a pair of contact mechanisms that are provided to correspond to a pair of circuits corresponding to a pair of poles and switch the pair of circuits;

a switching mechanism that is commonly provided in the pair of contact mechanisms and drives the pair of contact mechanisms to a circuit opening position or a circuit closing position;

a trip bar that is rotatable to a first position for latching the switching mechanism in the circuit closing position or to a second position for releasing the switching mechanism to operate to the circuit opening position; and an instant trip mechanism that presses the trip bar to rotate to the second position in response to a fault current on the circuit requiring an instant trip, wherein the instant trip mechanism comprises:

a pair of armature assemblies that are provided to correspond to the pair of poles and movable to a position for pressing the trip bar to rotate to the second position; and a pair of electromagnets that are provided to face the pair of armature assemblies and apply a magnetic attractive force to the pair of armature assemblies in response to the fault current on the circuit requiring an instant trip, wherein each of the pair of electromagnets comprises a cutout groove portion that is provided at a side surface corner or an upper surface for guiding a conductive wire electrically connecting a movable contact arm of a corresponding contact mechanism among the pair of contact mechanisms and a terminal.

2. The circuit breaker of claim 1, wherein each of the pair of armature assemblies comprises:

a first armature portion that is pivotally supported to be rotatable and has a cam surface portion for pressing the trip bar;

a second armature portion that is coupled to the first armature so as to be rotatable together and disposed to face the corresponding electromagnet; and a coupling portion that couples the first armature portion and the second armature portion.

3. The circuit breaker of claim 2, wherein the second armature portion is installed to at least partially overlap the facing electromagnet in order to increase a mutually facing area.

4. The circuit breaker of claim 2, further comprising:

a pair of bimetals that are connected to the pair of circuits, wherein the second armature portion is installed to surround each of the bimetal together with the facing electromagnet to form a closed loop of a magnetic path together with the corresponding electromagnet.

5. The circuit breaker of claim 2, wherein the second armature portion comprises a base portion that is disposed to face the corresponding electromagnet; and at least one wing portion extending from the base portion toward the corresponding electromagnet.

6. The circuit breaker of claim 5, wherein mutually facing surfaces of the wing portion of the second armature portion and the electromagnet are formed as inclined surfaces to increase a mutually facing area.

7. The circuit breaker of claim 2, wherein the electromagnet comprises:

a first electromagnet portion that is plate-shaped and disposed to face the corresponding second armature portion; and a pair of second electromagnet portions that are wing-shaped and extend from the first electromagnet portion toward the corresponding second armature portion.

8. The circuit breaker of claim 7, wherein a wing portion of the second armature portion comprises a stepped portion formed to have a shape corresponding to an end surface of the second electromagnet portion in order to increase the mutually facing area.

9. The circuit breaker of claim 2, wherein the electromagnet is configured as an L-shaped conductive metal plate having a vertical plate portion and a horizontal plate portion, and wherein the second armature portion comprises:

a base plate installed to face the vertical plate portion of the corresponding electromagnet; and at least one wing portion extending from the base plate portion toward the corresponding electromagnet.

10. The circuit breaker of claim 2, wherein the electromagnet comprises a first base plane portion facing the second armature portion and a first wing portion extending from the first base plane portion toward the second armature portion, wherein the second armature portion comprises a second base plane portion disposed to face the first base plane portion of the electromagnet and a second wing portion extending from the second base plane portion toward the electromagnet and meshed with the electromagnet, wherein any one of the first wing portion and the second wing portion comprises at least one concave portion formed to be concave on a surface facing the other of the first wing portion or the second wing portion, and wherein the other of the first wing portion and the second wing portion comprises at least one convex portion formed to be convex to correspond to the concave portion.

11. The circuit breaker of claim 2, wherein the electromagnet comprises a first base plane portion facing the second armature portion and a first wing portion extending from the first base plane portion toward the second armature portion, wherein the second armature portion comprises a second base plane portion disposed to face the first base plane portion of the electromagnet and a second wing portion extending from the second base plane portion toward the electromagnet and meshed with the electromagnet, and wherein the first wing portion and the second wing portion have a plurality of teeth meshed with each other.

12. The circuit breaker of claim 2, wherein the electromagnet comprises a first base plane portion facing the second armature portion and a first wing portion extending from the first based plane portion toward the second armature portion, wherein the second armature portion comprises a second base plane portion disposed to face the first base plane portion of the electromagnet and a second wing portion extending from the second base plane portion toward the electromagnet and meshed with the electromagnet, and wherein the first wing portion and the second wing portion have meander surfaces or a plurality of step surfaces meshed with each other.

13. The circuit breaker of claim 10, wherein the convex portion and the concave portion are formed in any one of a polygonal shape or a semicircular shape.

* * * * *